US009248895B1

(12) United States Patent
Gendron et al.

(10) Patent No.: US 9,248,895 B1
(45) Date of Patent: Feb. 2, 2016

(54) ACTUATOR FOR A GATE OF A WATERCRAFT JET PROPULSION SYSTEM

(71) Applicant: BOMBARDIER RECREATIONAL PRODUCTS INC., Valcourt (CA)

(72) Inventors: Jean-Philippe Gendron, Granby (CA); Sebastien Quirion, Magog (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 14/473,335

(22) Filed: Aug. 29, 2014

Related U.S. Application Data

(60) Provisional application No. 61/872,632, filed on Aug. 30, 2013.

(51) Int. Cl.
*B63H 11/00* (2006.01)
*B63H 1/30* (2006.01)
*B63H 5/00* (2006.01)

(52) U.S. Cl.
CPC ..... *B63H 11/00* (2013.01); *B63H 1/30* (2013.01); *B63H 5/00* (2013.01)

(58) Field of Classification Search
CPC ..... B63H 11/00; B63H 11/11; B63H 11/107; B63H 11/113; B63H 11/117
USPC ..... 440/41, 42
See application file for complete search history.

(56) References Cited

U.S. PATENT DOCUMENTS

| | | | | |
|---|---|---|---|---|
| 3,089,454 | A * | 5/1963 | Chronic | 440/41 |
| 5,752,864 | A * | 5/1998 | Jones et al. | 440/41 |
| 5,755,601 | A * | 5/1998 | Jones | 440/41 |
| 5,879,209 | A * | 3/1999 | Jones | 440/42 |
| 7,674,144 | B2 | 3/2010 | Bourret et al. | |
| 7,708,609 | B2 | 5/2010 | Plante et al. | |
| 7,775,844 | B2 | 8/2010 | St-Pierre et al. | |
| 7,841,915 | B2 | 11/2010 | Bourret et al. | |
| 7,892,053 | B2 | 2/2011 | St-Pierre et al. | |
| 7,901,259 | B2 | 3/2011 | Bourret et al. | |
| 8,000,851 | B2 | 8/2011 | St-Pierre et al. | |
| 8,177,594 | B2 | 5/2012 | Dagenais et al. | |
| 8,202,136 | B2 | 6/2012 | Dagenais et al. | |
| 8,216,007 | B2 | 7/2012 | Moore | |
| 8,478,465 | B2 | 7/2013 | St-Pierre et al. | |

FOREIGN PATENT DOCUMENTS

| | | |
|---|---|---|
| JP | 2010501402 A | 1/2010 |
| WO | 2008025169 A1 | 3/2008 |

OTHER PUBLICATIONS

English Abstract of JP2010501402; retrieved from http://worldwide.espacenet.com/ on Sep. 19, 2014.

* cited by examiner

*Primary Examiner* — Lars A Olson
(74) *Attorney, Agent, or Firm* — BCF LLP

(57) ABSTRACT

A watercraft has a hull, an engine compartment, an engine disposed and a jet pump. A gate is pivotable relative to the jet pump about a gate axis between an up and a down position. A gate actuator assembly includes an actuator housing fixed to the hull, and an actuator arm movable along an actuation axis with respect thereto. The actuator arm is operatively connected to the gate for pivoting the gate about the gate axis. A sealing member encloses a portion of the actuator arm between the actuator housing and the gate. The sealing member extends between a first end fixed with respect to the actuator housing and a second end fixed with respect to the actuator arm, forming a variable volume outer chamber to prevent entry of fluid therein. A passage fluidly communicating with the outer chamber, extends through the hull into the engine compartment.

20 Claims, 20 Drawing Sheets

ACTUATOR FOR A GATE OF A WATERCRAFT JET PROPULSION SYSTEM

CROSS-REFERENCE

The present application claims priority to U.S. Provisional Patent Application No. 61/872,632 filed on Aug. 30, 2013, the entirety of which is incorporated herein by reference.

FIELD OF THE TECHNOLOGY

The present technology relates to actuators for a gate of a watercraft jet propulsion system.

BACKGROUND

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes the steering nozzle to turn left or right to redirect the jet of water and thereby steer the watercraft.

To be able to move in the reverse direction, the jet propulsion system of these watercraft are usually provided with a reverse gate. The reverse gate is movable between stowed positions and reverse positions. In the stowed positions, the reverse gate does not interfere with the jet of water coming from the steering nozzle, thus allowing the watercraft to move forward. In the reverse positions, the reverse gate redirects the jet of water coming from the steering nozzle towards a front of the watercraft, thus causing the watercraft to move in a reverse direction. The reverse gate is typically manually activated by the driver via a lever positioned near the driver. Cables and linkages are used to connect the lever with the reverse gate.

A reverse gate can also be used as part of a vehicle braking system wherein the jet of water is redirected towards a front of the watercraft while the vessel is moving forwards, so as to slow and ultimately stop the vessel's forward motion.

It would be desirable to have an actuator for actuation of the watercraft gate that can be conveniently assembled with the jet propulsion system and that allows electronic control of the reverse gate.

SUMMARY

It is an object of the present technology to ameliorate at least some of the inconveniences present in the prior art.

According to one aspect of the present technology, there is provided a watercraft including a hull, an engine compartment defined at least in part by the hull, and an engine disposed in the engine compartment. A jet pump is connected to the hull and operatively connected to the engine, the jet pump creating a fluid jet and thereby propelling the watercraft. A gate is pivotable relative to the jet pump about a gate axis between an up position and a down position to redirect the fluid jet when in the down position. A gate actuator assembly includes an actuator housing fixed to the hull, and an actuator arm being movable along an actuation axis with respect to the actuator housing. The actuator arm is operatively connected to the gate for pivoting the gate about the gate axis. A sealing member encloses a portion of the actuator arm between the actuator housing and the gate. The sealing member extends between a first end and a second end. The first end is fixed with respect to the actuator housing. The second end is fixed with respect to the actuator arm. The sealing member forms a variable volume outer chamber between the first and second ends and around the portion of the actuator arm. The sealing member prevents entry of fluid from outside the engine compartment into the outer chamber. A passage, in fluid communication with the outer chamber, extends through the hull into the engine compartment.

In some implementations, the sealing member is a bellows.

In some implementations, the passage is in fluid communication with the engine compartment.

In some implementations, an inner member forms an inner chamber disposed in the engine compartment. The passage fluidly communicates the outer chamber with the inner chamber.

In some implementations, the inner chamber is a variable volume chamber.

In some implementations, the inner member is a bellows.

In some implementations, the actuator housing is mounted within the engine compartment and the actuator arm extends through an opening in the hull.

In some implementations, a portion of the actuator housing extends through the opening of the hull around the actuator arm.

In some implementations, the passage is defined at least in part between the portion of the actuator housing and the actuator arm.

In some implementations, the sealing member is an outer bellows. A first end of the outer bellows is fixed to the portion of the actuator housing and a second end of the outer bellows is fixed to the actuator arm.

In some implementations, an inner member form an inner chamber disposed in the engine compartment and connected to the portion of the actuator housing. The passage fluidly communicates the outer chamber with the inner chamber.

In some implementations, the portion of the actuator housing includes an inner flange disposed adjacent to an inner surface of the hull, and a sleeve extending from the inner flange through the opening of the hull and around the actuator arm. One of an outer and an inner surface of the sleeve is threaded. An outer flange is threadedly fastened to the sleeve so as to retain the hull between the inner flange and the outer flange.

In some implementations, the actuator arm includes a shaft at least partially enclosed by the actuator housing and movable with respect to the actuator housing along the actuation axis, and a linkage pivotably connected to the shaft. The linkage is connected to the gate and pivotable about a pivot axis disposed generally perpendicular to the actuation axis and parallel to the gate axis when the gate pivots about the gate axis.

In some implementations, the linkage is disposed along the actuation axis when the gate is in at least one of the up position and the down position.

In some implementations, the linkage is disposed along the actuation axis when the gate is in the up position, the linkage is disposed along the actuation axis when the gate is in the down position, and the linkage is disposed at a non-zero angle with respect to actuation axis when the gate is in a position between the up position and the down position.

In some implementations, the gate actuator assembly further comprises a position sensor adapted to sense a position of the actuator arm with respect to the actuator housing.

In some implementations, the position sensor is a hall-effect sensor.

According to another aspect of the present technology, there is provided a gate actuator assembly for pivoting a gate of a watercraft having a jet propulsion system and a hull, the hull defining at least in part and engine compartment. The gate actuator assembly includes an actuator housing adapted to be connected to the hull. An actuator arm is movable along an actuation axis with respect to the actuator housing and adapted to be operatively connected to the gate for pivoting the gate. A sealing member encloses a portion of the actuator arm outside the actuator housing. The sealing member extending between a first end and a second end, the first end being fixed with respect to the actuator housing, the second end being fixed with respect to the actuator arm. The sealing member forms a variable volume outer chamber between the first and second ends and around the portion of the actuator arm. The sealing member is adapted to prevent entry into the outer chamber of fluid from outside the outer chamber. The sealing member is adapted for fluid communication with a passage extending through the hull into the engine compartment.

In some implementations, the actuator housing is adapted to be mounted inside the engine compartment, the actuator arm is adapted to extend through an opening of the hull, and a portion of the actuator housing is adapted to extend through the opening of the hull around the actuator arm.

In some implementations, the sealing member is a bellows.

In some implementations, an inner member defines an inner chamber. The inner member is adapted to be disposed inside the engine compartment. The passage fluidly communicates the outer chamber with the inner chamber.

In some implementations, the inner chamber is a variable volume chamber.

In some implementations, the inner member is a bellows.

In some implementations, a position sensor adapted to sense a position of the actuator arm with respect to the actuator housing.

In some implementations, the position sensor is a hall-effect sensor.

In some implementations, the actuator arm includes a shaft at least partially enclosed by the actuator housing and movable with respect to the actuator housing along the actuation axis, and a linkage pivotably connected to the shaft. The linkage is adapted to be connected to the gate and is pivotable about a pivot axis disposed generally perpendicular to the actuation axis for pivoting the gate about a gate axis.

For purposes of this application, terms related to spatial orientation such as forwardly, rearwardly, left, and right, are as they would normally be understood by a driver of the watercraft sitting thereon in a normal driving position. Terms related to spatial orientation when referring to the jet propulsion system alone should be understood as they would normally be understood when the jet propulsion system is installed on a watercraft. The explanations provided above regarding the above terms take precedence over explanations of these terms that may be found in any one of the documents incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The implementations of the present watercraft jet propulsion system will be described with respect to a personal watercraft. However, it is contemplated that implementations of the present watercraft jet propulsion system could be used with other types of watercraft.

The general construction of a personal watercraft 10 will be described with respect to FIGS. 1 to 5. The following description relates to one way of manufacturing a personal watercraft. Those of ordinary skill in the watercraft art should recognize that there are other known ways of manufacturing and designing personal watercraft and that these are contemplated.

Figure 1:
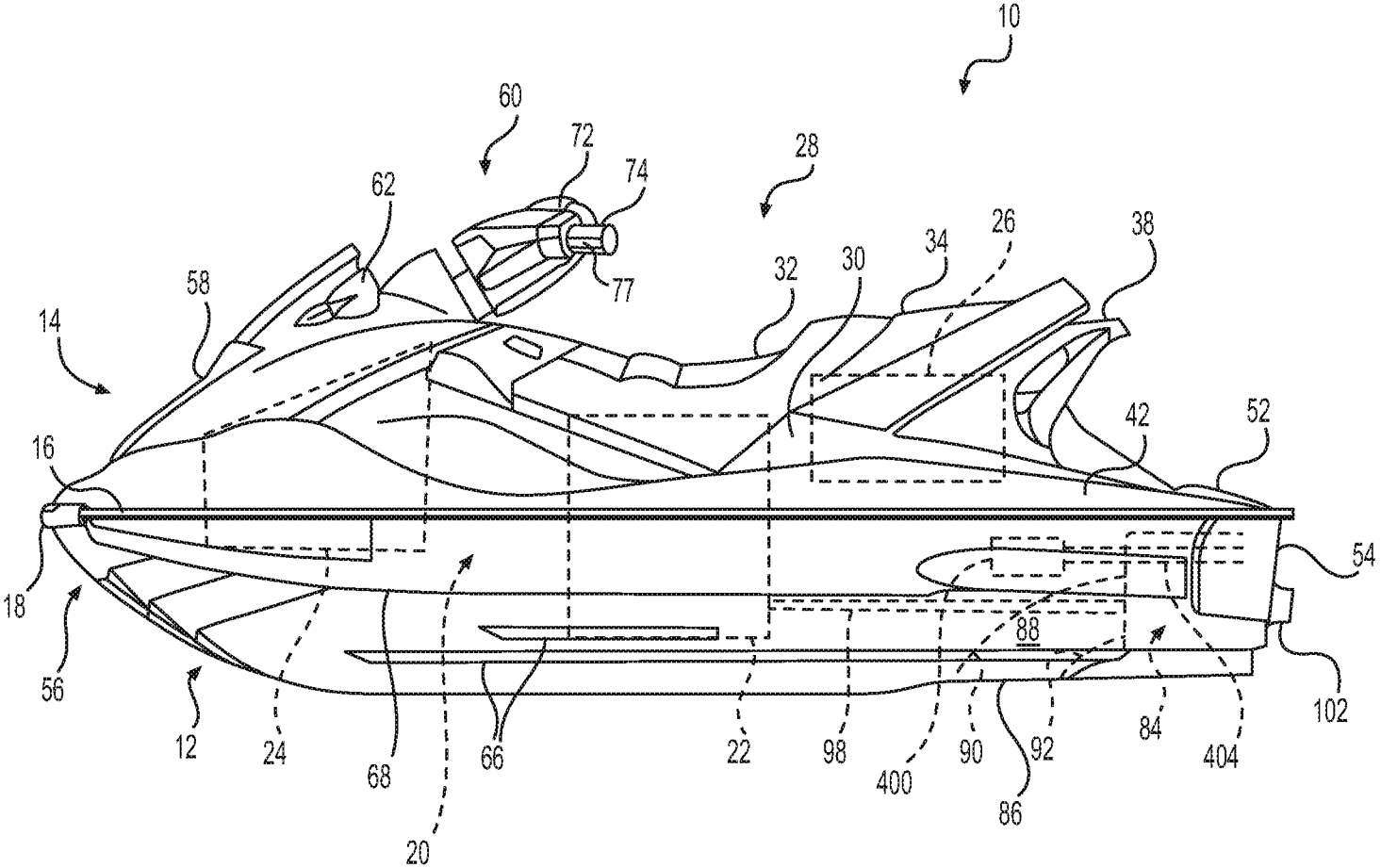
FIG. 1 illustrates a left side elevation view of a personal watercraft.

The personal watercraft 10 of FIG. 1 includes a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. The seam 16 comprises a bond line formed by an adhesive. Other known joining methods could be used to sealingly engage the hull 12 and deck 14 together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or the entire seam 16.

The space between the hull 12 and the deck 14 forms a volume commonly referred to as the engine compartment 20. The engine compartment 20 accommodates an engine 22 (shown schematically in FIG. 1), as well as a muffler, gas tank, electrical system (battery, electronic control unit, etc.), air box, storage bins 24, 26, and other elements required or desirable in the watercraft 10.

Figure 2:
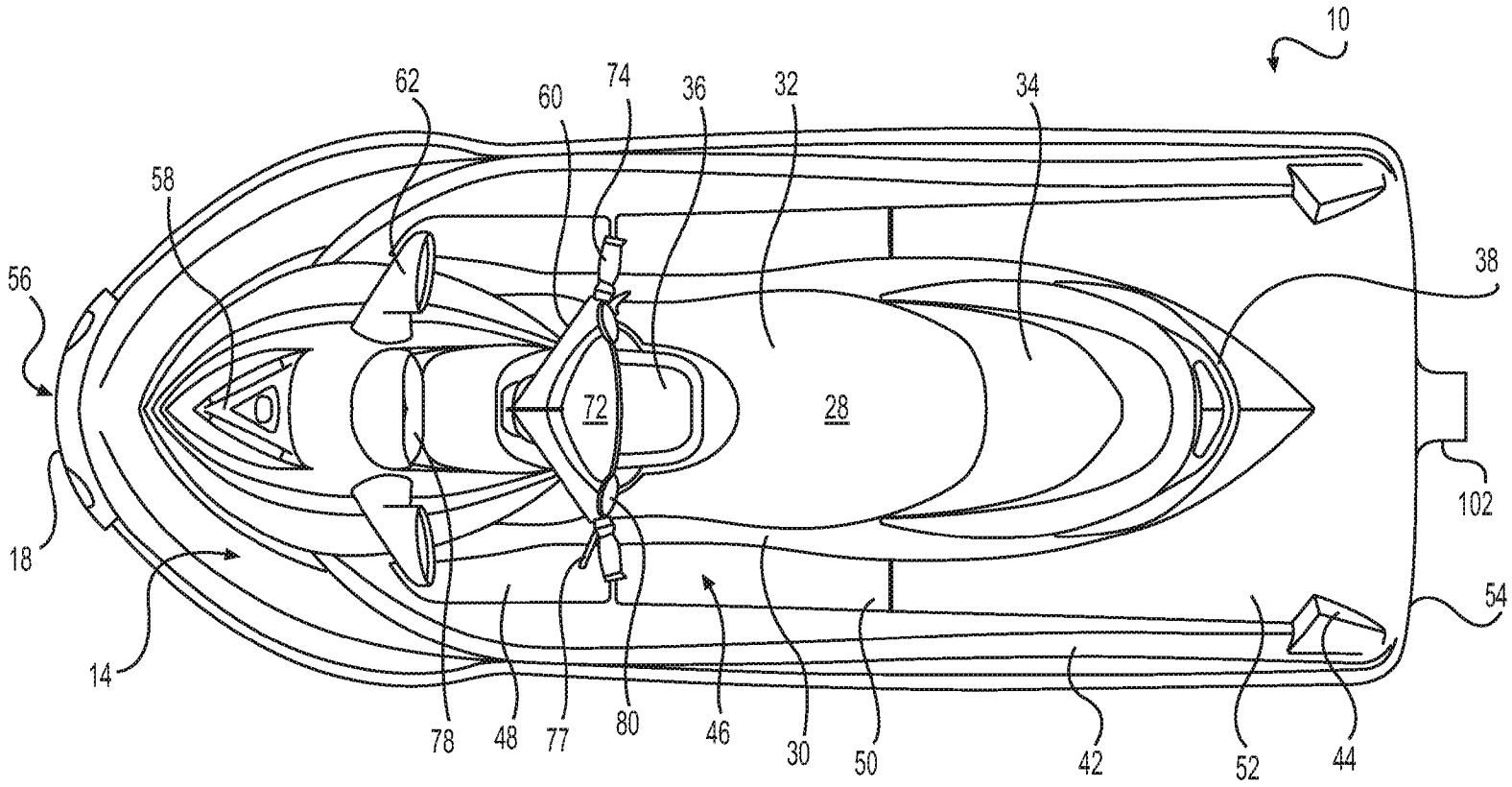
FIG. 2 is a top plan view of the watercraft of FIG. 1.

As seen in FIGS. 1 and 2, the deck 14 has a centrally positioned straddle-type seat 28 positioned on top of a pedestal 30 to accommodate a driver and a passenger in a straddling position. The seat 28 includes a first, front seat portion 32 and a second, rear, raised seat portion 34. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). It is contemplated that the seat 28 could be a single seat element. It is also contemplated that the seat 28 could be sized to accommodate only a driver or a driver and more than one passenger. A "glove compartment" or small storage box 36 is provided in front of the seat 28.

A grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

Figure 4:
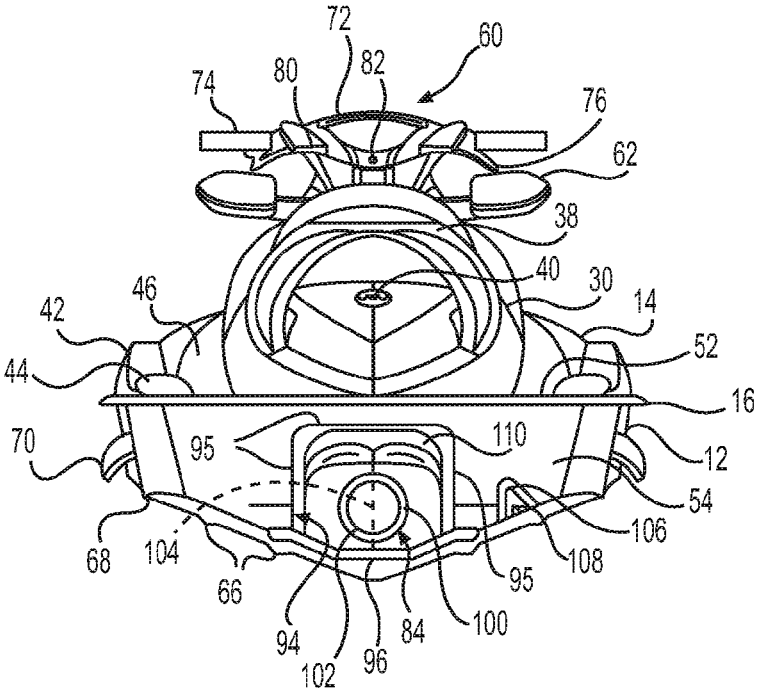
FIG. 4 is a rear elevation view of the watercraft of FIG. 1.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the riders' feet could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the driver or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
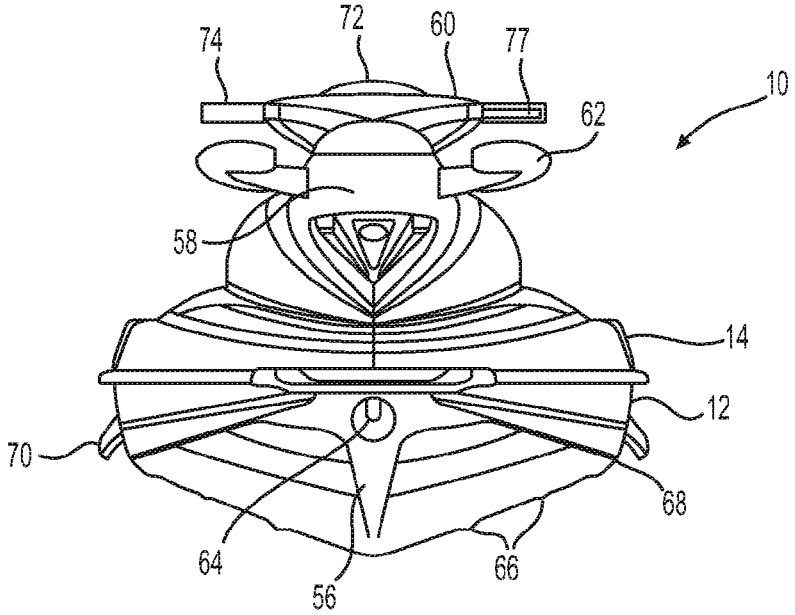
FIG. 3 is a front elevation view of the watercraft of FIG. 1.

Referring to the bow 56 of the watercraft 10, as seen in FIGS. 2 and 3, the watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to the front storage bin 24 (FIG. 1). A latch (not shown) located at a rearward portion of the hood 58 locks the hood 58 into a closed position. When in the closed position, the hood 58 prevents water from entering the front storage bin 24. Rearview mirrors 62 are positioned on either side of the hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer for instance.

Figure 5:
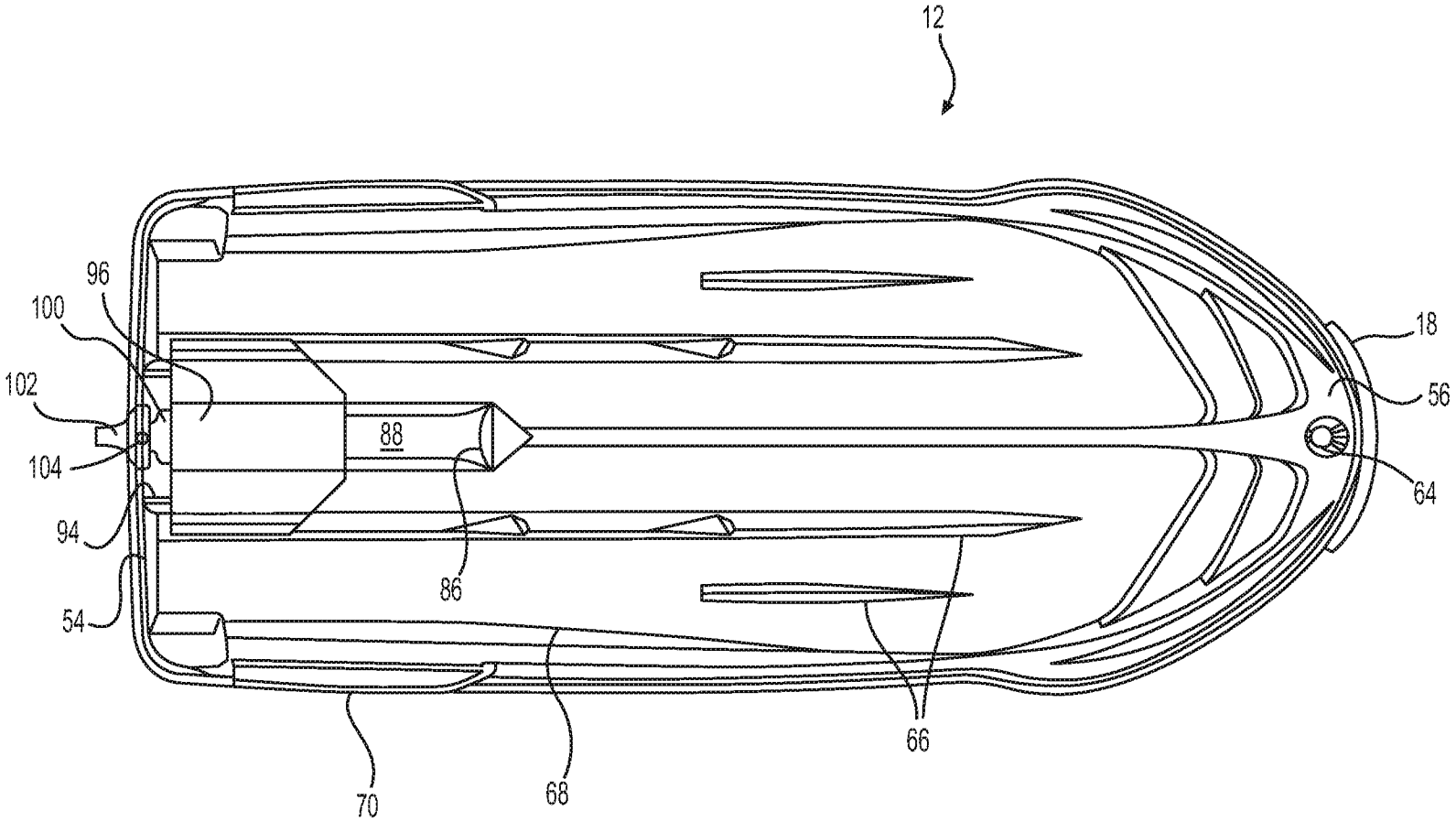
FIG. 5 is a bottom plan view of the hull of the watercraft of FIG. 1.
Figure 6:
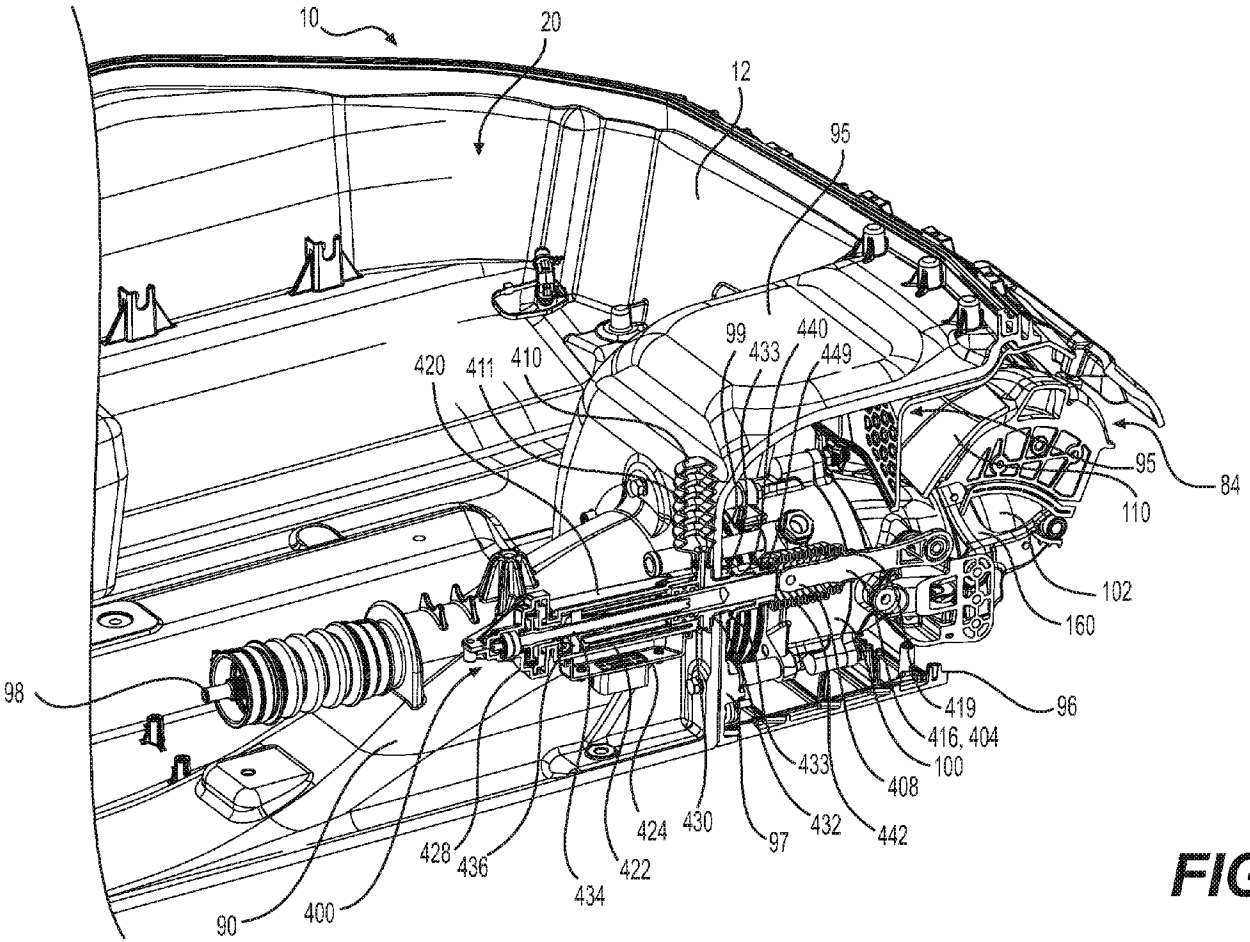
FIG. 6 is a perspective cross-sectional view taken from a front, left side of the watercraft of FIG. 1 with the deck removed to show the engine compartment, the jet propulsion system and the gate actuator assembly.
Figure 7A:
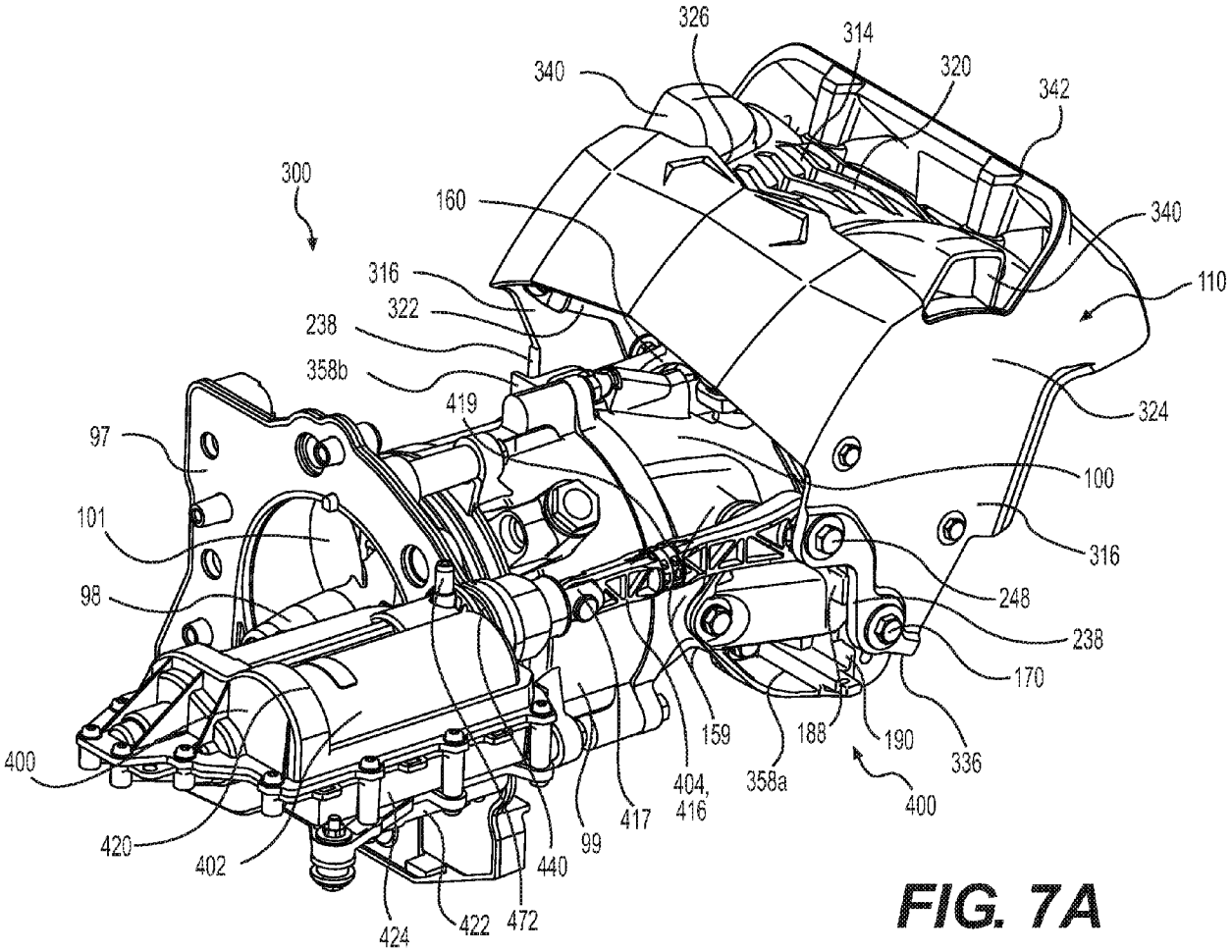
FIG. 7A is a perspective view taken from a front, left side of the jet propulsion system and gate actuator assembly of FIG. 6 shown in isolation, with the gate being shown in a stowed position.
Figure 7B:
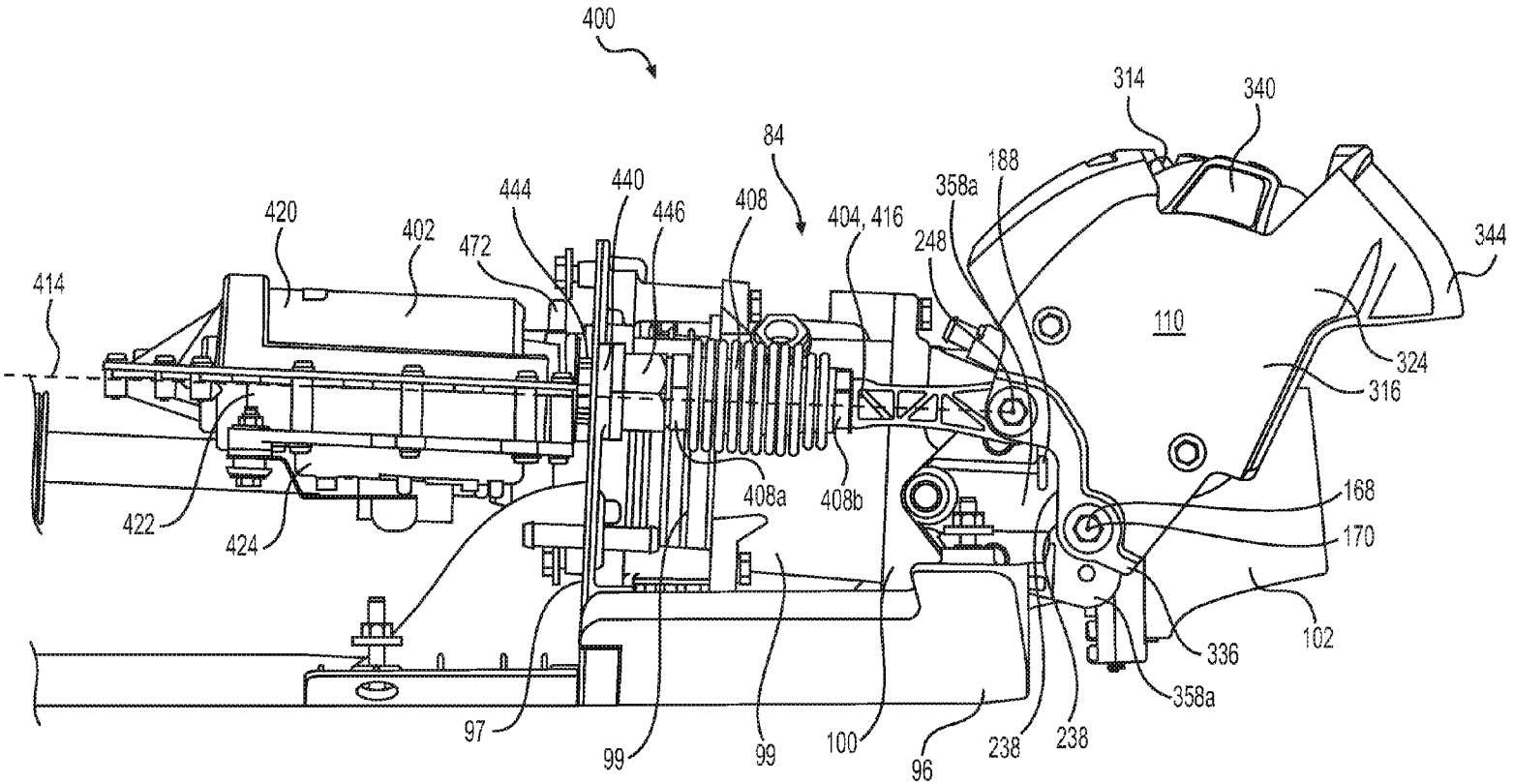
FIG. 7B is a left side elevation view of the jet propulsion system and gate actuator assembly of FIG. 7A.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 could be adjusted with respect to the hull 12 to change the handling characteristics of the watercraft 10 and to accommodate different riding conditions.

As best seen in FIGS. 3 and 4, the helm assembly 60 is positioned forwardly of the seat 28. The helm assembly 60 has a central helm portion 72 that may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of, but not limited to, a thumb-actuated throttle lever (as shown), a finger-actuated throttle lever, or a twist grip. The throttle operator 76 is movable between an idle position and multiple actuated positions. The throttle operator 76 is biased towards the idle position, such that when the driver of the watercraft 10 lets go of the throttle operator 76, it moves to the idle position. The other of the steering handles 74 is provided with a lever 77 used by the driver to control the jet propulsion system 84 as described in greater detail below. It is contemplated that the lever 77 could be omitted. In such an implementation, the lever 77 could be replaced by another type of input to the jet propulsion system 84, such as buttons or switches, or the aspects of the jet propulsion system 84 that would have been controlled by the lever 77 could be controlled automatically.

As seen in FIG. 2, a display area or cluster 78 is located forwardly of the helm assembly 60. The display cluster 78 can be of any conventional display type, including, but not limited to, a liquid crystal display (LCD), dials or LED (light emitting diodes). The central helm portion 72 has various buttons 80, which could alternatively be in the form of levers or switches, that allow the driver to modify the display data or mode (speed, engine rpm, time . . . ) on the display cluster 78. It is contemplated that in some implementations, the buttons 80 may also be used by the driver to control the jet propulsion system 84 as described in greater detail below.

The helm assembly 60 also has a key receiving post 82 located near a center of the central helm portion 72. The key receiving post 82 is adapted to receive a key (not shown) that starts the watercraft 10. The key is typically attached to a safety lanyard (not shown). It should be noted that the key receiving post 82 may be placed in any suitable location on the watercraft 10.

The watercraft 10 is generally propelled by a jet propulsion system 84. The jet propulsion system 84 pressurizes water to create thrust. The water is first scooped from under the hull 12 through an inlet 86, which has a grate (not shown in detail). The inlet grate prevents large rocks, weeds, and other debris from entering the jet propulsion system 84, which may damage the jet propulsion system 84 or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. As seen in FIG. 4, the jet propulsion system 84 is located in a formation in the hull 12, referred to as the tunnel 94. The tunnel 94 is defined at the front, sides, and top by walls 95 formed by the hull 12 and is open at the transom 54. The bottom of the tunnel 94 is closed by a ride plate 96. The ride plate 96 creates a surface on which the watercraft 10 rides or planes at high speeds.

Figure 8A:
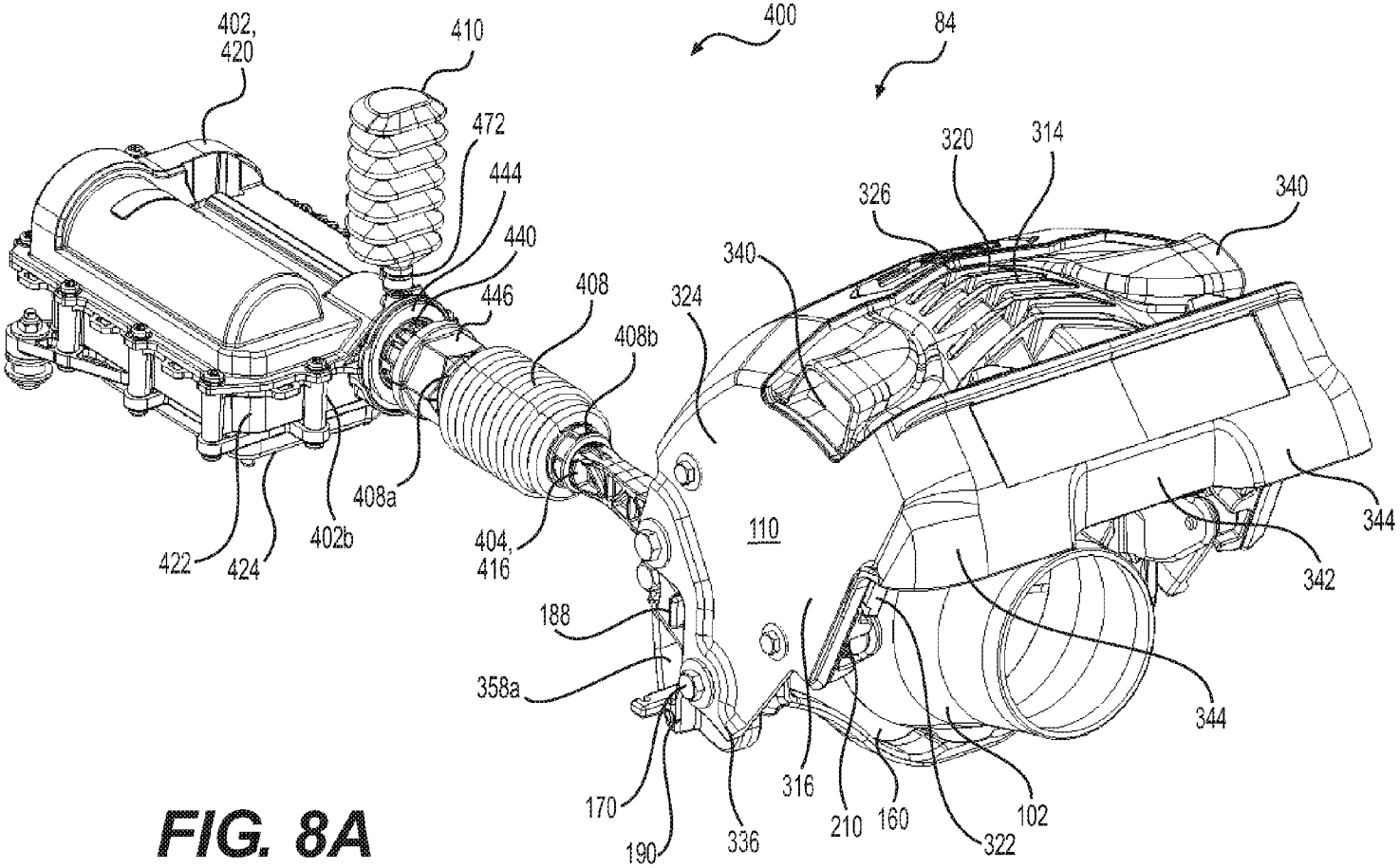
FIG. 8A is a perspective view taken from a rear, left side of the venturi and steering nozzle of the jet propulsion system and the gate actuator assembly of FIG. 7A with the gate being shown in a stowed position.
Figure 8B:
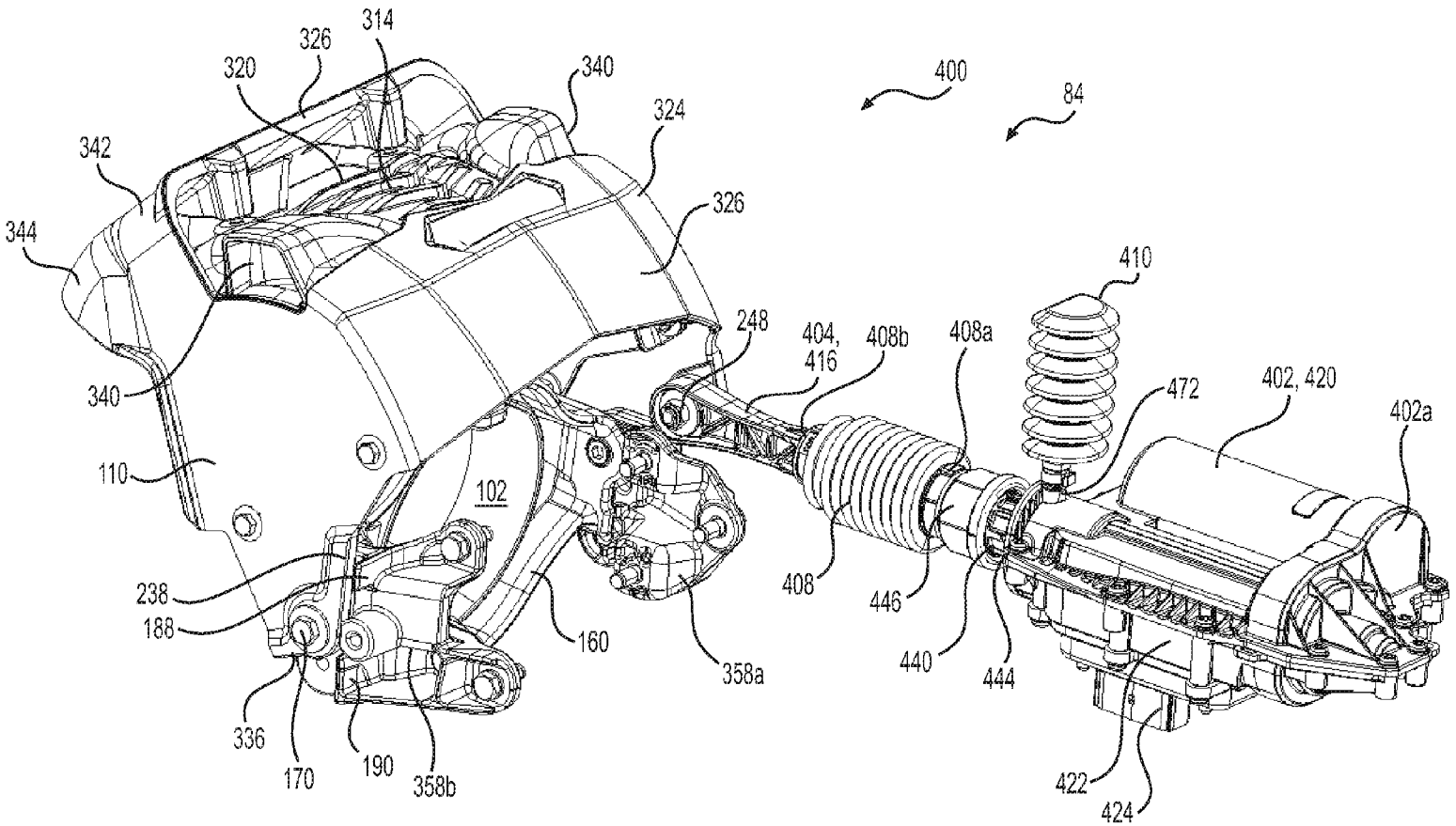
FIG. 8B is a perspective view taken from a front, right side of the venturi, steering nozzle and gate actuator assembly of FIG. 7A.
Figure 8C:
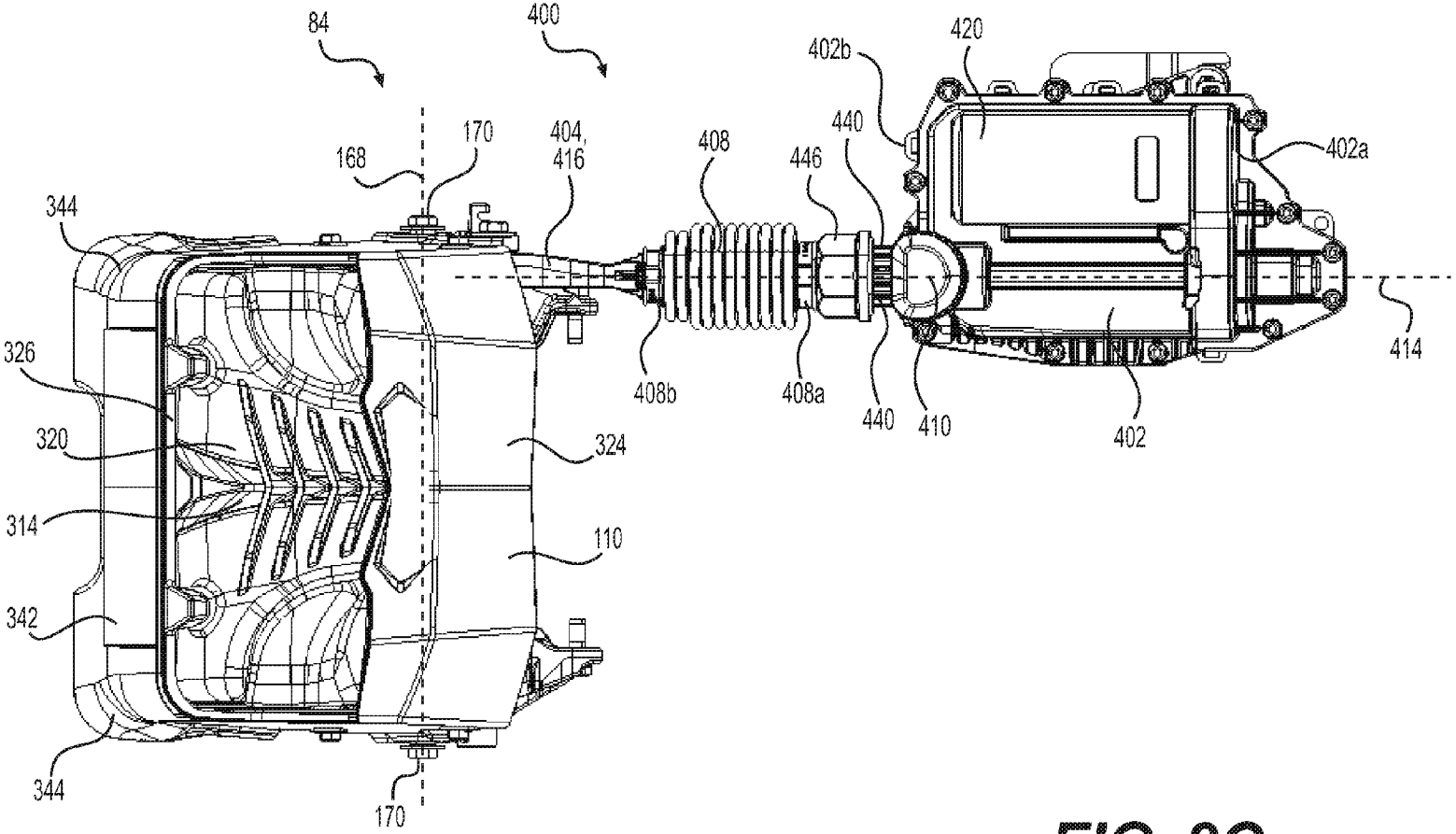
FIG. 8C is a top plan view of the venturi, steering nozzle and gate actuator assembly of FIG. 8A.
Figure 9A:
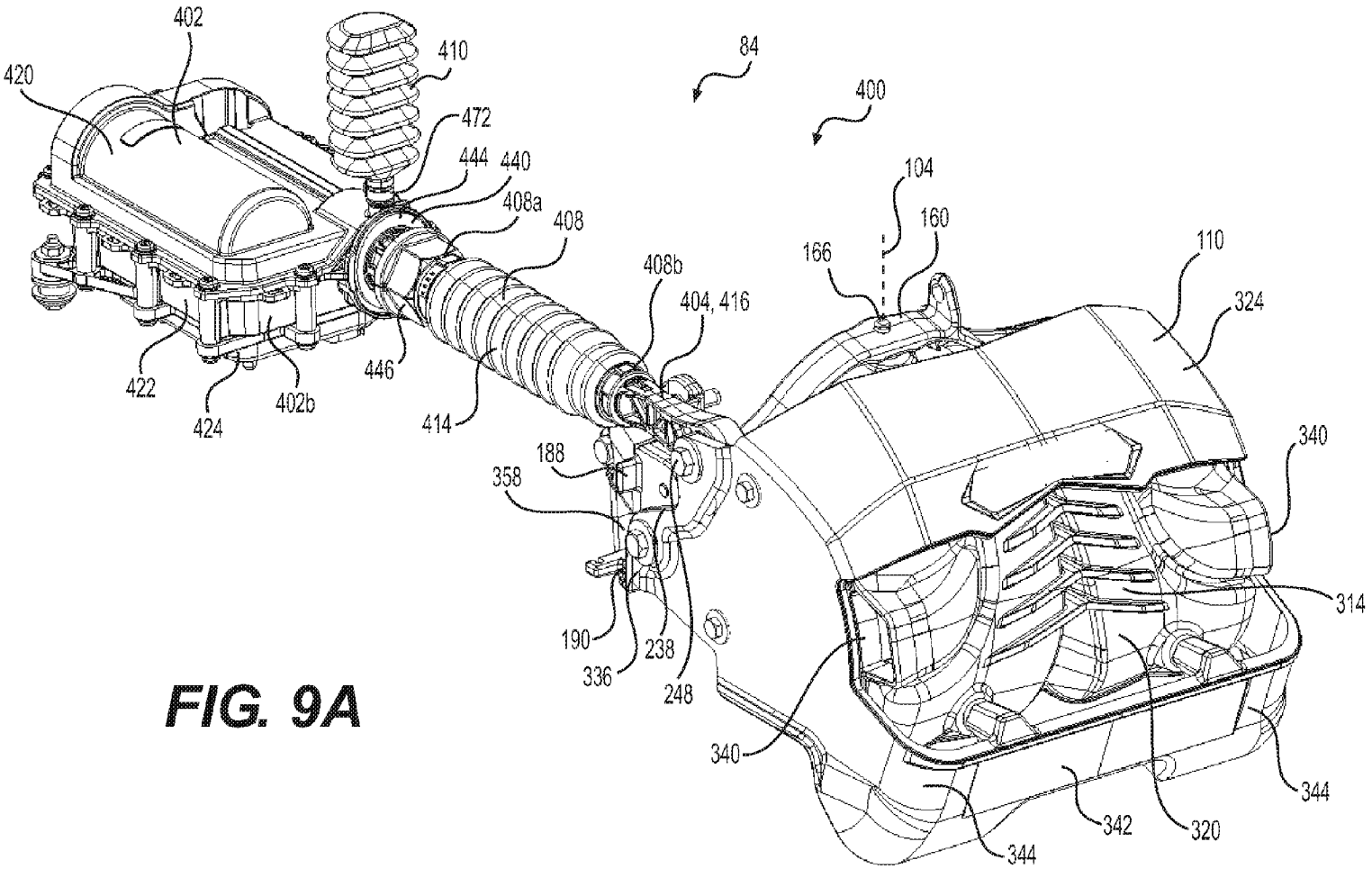
FIG. 9A is a perspective view taken from a rear, left side of the venturi, steering nozzle and gate actuator assembly of FIG. 7A with the gate being shown in a lowered or reverse position.
Figure 9B:
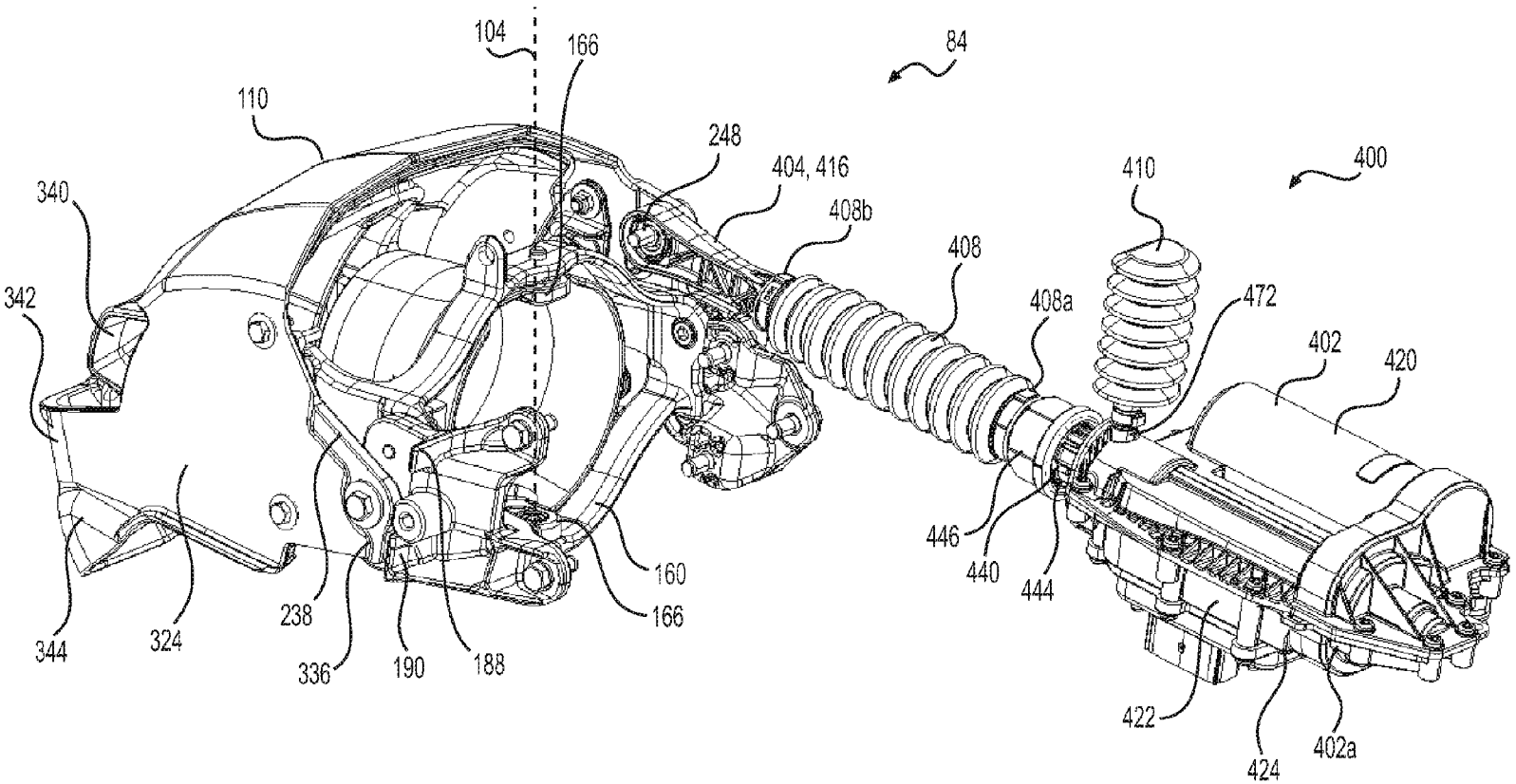
FIG. 9B is a perspective view taken from a front, right side of the venturi, steering nozzle and gate actuator assembly of FIG. 7A.
Figure 10A:
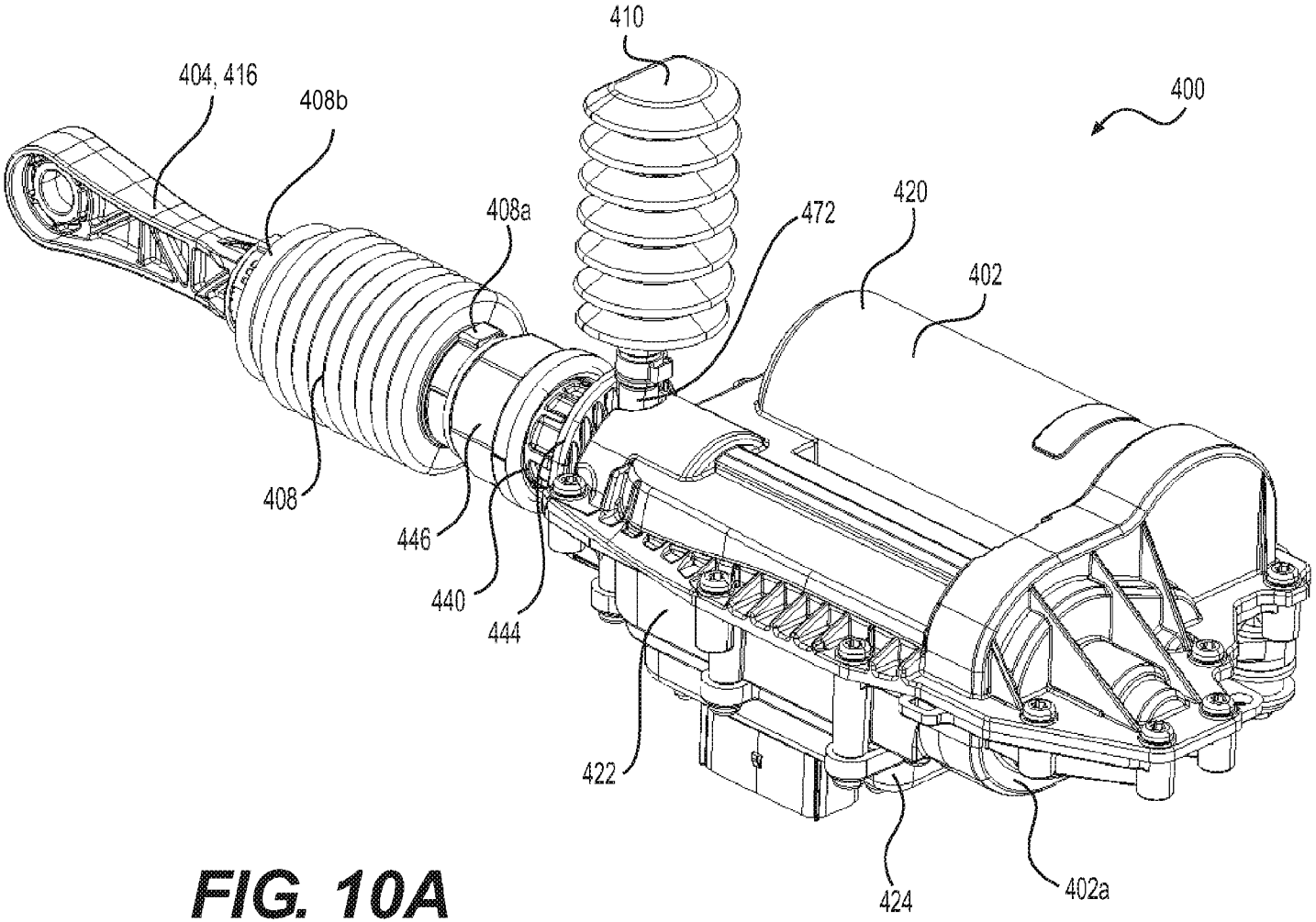
FIG. 10A is a perspective view taken from a front, right side of the gate actuator assembly of FIG. 7A shown in isolation, with the actuator in a retracted position.
Figure 10B:
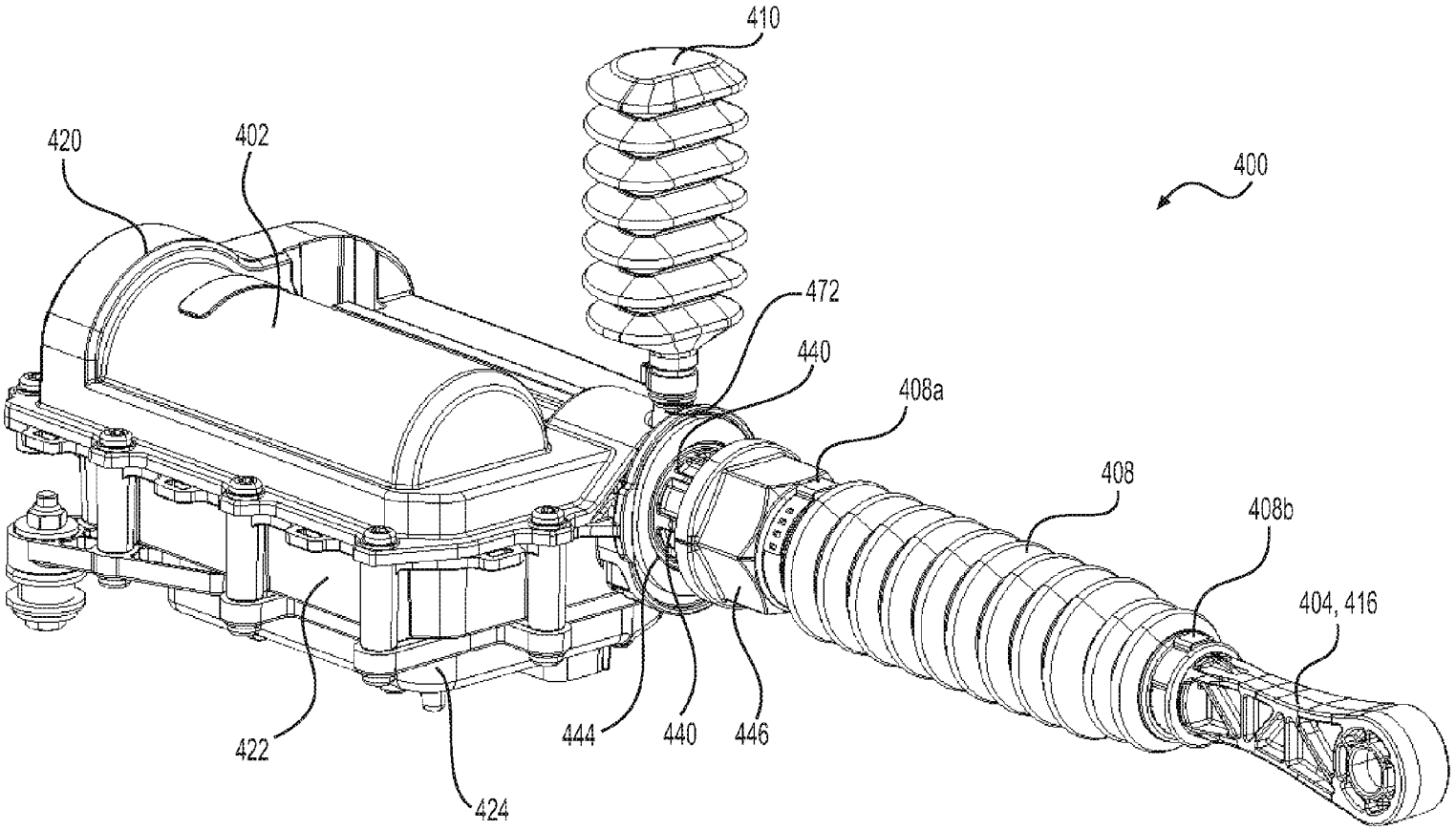
FIG. 10B is a perspective view taken from a rear, left side of the gate actuator assembly of FIG. 9A, with the actuator in an extended position.
Figure 11A:
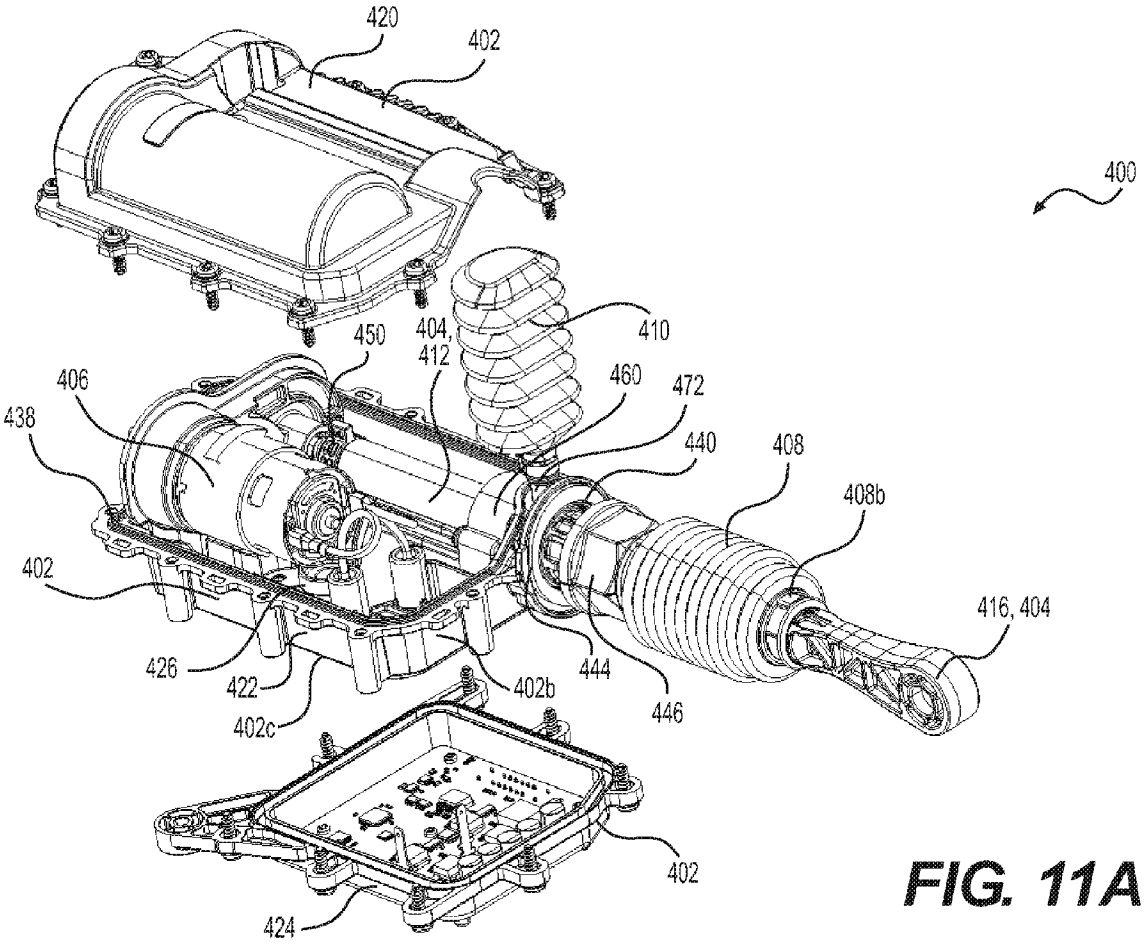
FIG. 11A is an exploded perspective view taken from a top, rear, left side of the gate actuator assembly of FIG. 10A
Figure 11B:
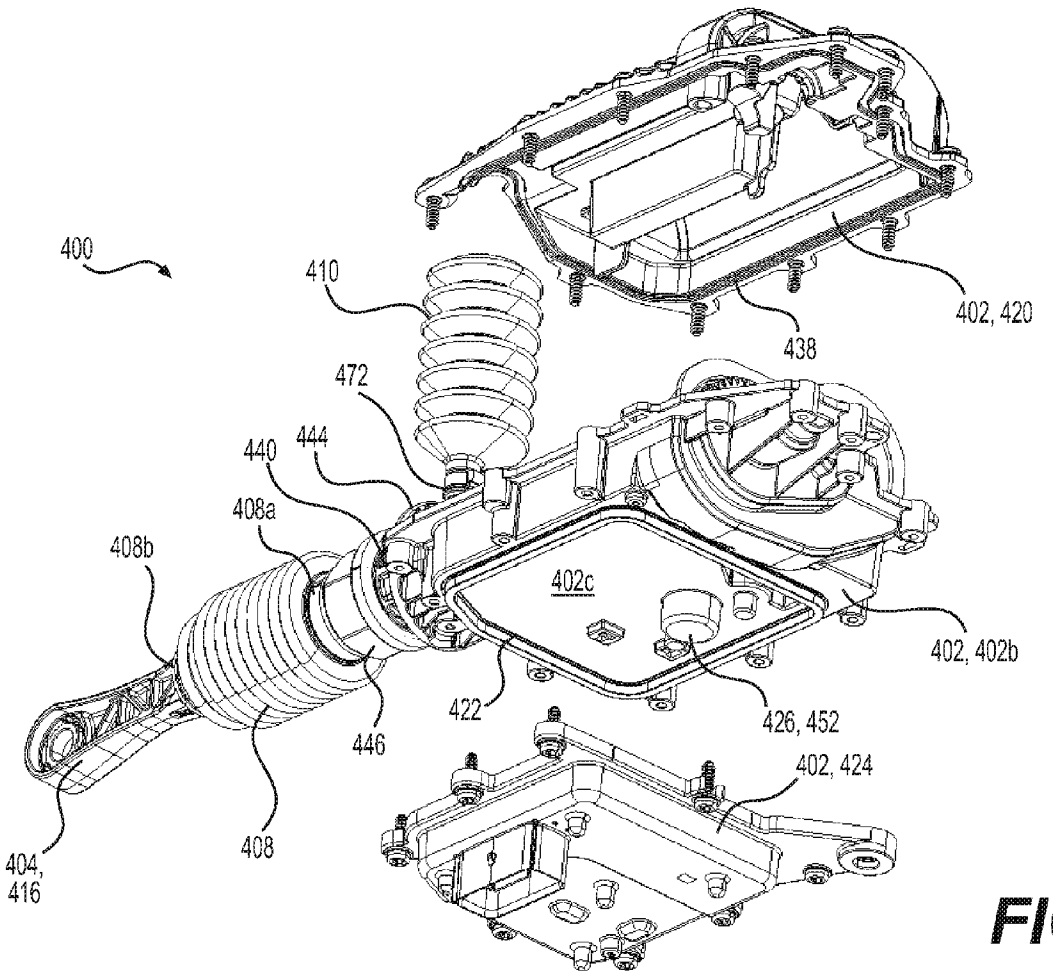
FIG. 11B is an exploded perspective view taken from a bottom, front, right side of the gate actuator assembly of FIG. 10A.

The jet propulsion system 84 includes a jet pump 99. The forward end of the jet pump 99 is connected to the front wall 95 of the tunnel 94 via a pump mounting plate 97 (FIGS. 8, 9A and 9B). The jet pump 99 includes an impeller 101 and a stator (not shown). The impeller 101 is coupled to the engine 22 by one or more shafts 98, such as a driveshaft and an impeller shaft. The rotation of the impeller 101 pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. The venturi's exit diameter is smaller than its entrance diameter. As a result the water is accelerated further, thereby providing more thrust. A steering nozzle 102 is rotationally mounted relative to the venturi 100 so as to pivot about a steering axis 104 (FIG. 4).

The jet propulsion system 84 includes a Variable Trim System (VTS) for controlling trimming of the steering nozzle 102. Left and right side brackets 358A and 358B are fastened to bosses 159 formed on the left and right sides of the venturi 100 respectively. A variable trim system (VTS) support 160 is rotationally mounted to the left and right side brackets 358A, 358B about a VTS axis (not indicated). The VTS axis extends generally laterally and horizontally. The VTS support 160 is disposed between the brackets 358A, 358B. It is contemplated that the VTS support 160 could be rotationally mounted directly to the jet pump 99 or the venturi 100 so as to be rotationally mounted relative to the venturi 100. It is also contemplated that the VTS support 160 could be rotationally mounted to the side walls 95 of the tunnel 94 directly or through suitable brackets so as to be rotationally mounted relative to the venturi 100. The VTS support 160 is in the shape of a ring and is therefore a VTS ring, but other shapes are contemplated. The VTS support 160 encircles the forward portion of the steering nozzle 102. The steering nozzle 102 is rotationally mounted via fasteners 166 (FIG. 9B) at a top and bottom of the VTS support 160 about the steering axis 104 (FIG. 9B) such that the steering nozzle 102 rotates with the VTS support 160. The steering axis 104 is perpendicular to the VTS axis. The steering nozzle 102 is operatively connected to the helm assembly 60 via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction. The VTS support 160 and the operation of the VTS is described in detail in U.S. patent application Ser. No. 13/902,321 filed on May 24, 2013, the entirety of which is incorporated herein by reference.

In the implementation of the watercraft 10 illustrated herein, the jet propulsion system 84 is disposed in the tunnel 94. However, it is contemplated that the jet propulsion system 84 could be mounted directly to the transom 54.

The jet propulsion system 84 is provided with a gate 110 that is movable between a plurality of positions. In the illustrated implementation, the gate 110 is a reverse gate 110 that is movable between a plurality of up (stowed) positions (FIG. 7A to 8C) where it does not interfere with a fluid jet being expelled by the steering nozzle 102 and a plurality of down (lowered or reverse) positions (FIGS. 9A and 9B) where it redirects the fluid jet being expelled by the steering nozzle 102. The reverse gate 110 is used to cause the watercraft 10 to move in a reverse direction by redirecting the jet of water being expelled by the steering nozzle 102 toward a front of the watercraft 10. In some implementations, the reverse gate 110 can also be used to cause the forwardly moving watercraft 10 to decelerate by redirecting the jet of water from the steering nozzle 102 in the same manner and/or by creating drag in the water. It is contemplated that the reverse gate 110 could be replaced by another type of gate that is not shaped to redirect the jet of water being expelled by the steering nozzle 102 toward a front of the watercraft 10, and thus does not allow the watercraft 10 to move in the reverse direction, but that is suitably shaped to decelerate the watercraft 10 when lowered.

As can be seen in FIGS. 9A and 9B, the reverse gate 110 is made of a reverse gate body 314, left and right tracks 322 and a shell 324. The reverse gate body 314 and the tracks 322 are made of plastic. It is contemplated that the reverse gate body 314 and the tracks 322 could be made of metal or another material. The shell 324 is made of metal. It is contemplated that the shell 324 could be made of plastic or another material.

The reverse gate body 314 has an inner arcuate surface (not seen) and an outer arcuate surface 320. When the reverse gate 110 is rotated about the reverse gate axis 168 (FIGS. 7B and 8C) such that at least a portion of the inner arcuate surface faces at least a portion of the outlet of the steering nozzle 102, the inner arcuate surface redirects at least a portion of a jet of water being expelled from the steering nozzle 102. The reverse gate body 314 also defines two apertures 340. The apertures 340 create a lateral jet of water when the reverse gate 110 is lowered and the steering nozzle 102 is turned while the jet pump 99 is in operation, thus assisting in steering of the watercraft 10. The reverse gate body 314 is disposed inwardly of the shell 324 and is fastened thereto.

The shell 324 has two side walls 316. Each side wall 216 is connected to the side brackets 358A, 358B about the reverse gate axis 168 using the fasteners 170. The left side bracket 358A defines an upper reverse gate stopper 188 and a lower reverse gate stopper 190. Although different in overall shape, the right bracket 358B also has stoppers 188 and 190. The actuator arm 404 is operatively connected to the left side wall 316 by fastener 248. The actuator arm 404 and its connection to the reverse gate 110 will be described in greater detail further below. Each side wall 316 also defines a surface 336 that abuts its corresponding lower reverse gate stopper 190 when the reverse gate 110 is in its fully lowered position. Each side wall 316 also defines the surface 238 that abuts its corresponding upper reverse gate stopper 188 when the reverse gate 110 is in its fully raised position. The shell 324 defines a window 326 through which the reverse gate body 314 protrudes partially. The shell 324 also defines a deflector plate 342 to increase the drag created by the reverse gate 110 in the water when the reverse gate 110 is lowered. It is contemplated that the deflector plate 342 could be a separate part that is fastened to the shell 324 and to the reverse gate body 314. The deflector plate 342 has two deflectors 344 that are spaced from the outer arcuate surface 320 of the reverse gate body 314. The deflectors 344 increase the drag created by the reverse gate 110 in the water when the reverse gate 110 is lowered Tracks 322 (FIGS. 7A and 8A) are fastened to the side walls 316 of the shell 324 on inner sides thereof. Each track 322 defines a channel 228 inside which a corresponding roller (not indicated) of the VTS support 160 is received for certain positions of the reverse gate 110 where the motion of the reverse gate 110 is coupled to the trim angle of the steering nozzle 102 and VTS support 160.

The gate actuator assembly 400 will now be described with reference to FIGS. 6 to 14. The gate actuator assembly 400 includes the actuator housing 402, the actuator arm 404, an electric motor 406, a sealing member 408 and an inner member 408.

The actuator arm 404 includes a shaft 412 and a linkage 416. The rear end of the linkage 416 is fastened to the reverse gate 110 with the fastener 248. The actuator arm 404 is part of an electrical linear actuator that pushes or pulls on the linkage 416 to cause the reverse gate 110 to rotate down or up respectively about the reverse gate axis 168 and as a result causes the VTS support 160 and steering nozzle 102 to trim down or up respectively over a certain range of rotation of the reverse gate 110. It is contemplated that other types of actuators could be used, such as, for example, a hydraulic actuator.

The actuator housing 402 is disposed inside the engine compartment 20. The actuator housing 402 is mounted to a front wall 95 of the tunnel 94 and extends forwardly therefrom. It is also contemplated that the actuator housing 102 could be mounted elsewhere within the engine compartment 20 other than the tunnel wall 95. For example, the actuator housing 402 could be mounted to the transom 54. It is contemplated that the actuator housing 402 could be located in the tunnel 94 or more forwardly inside the engine compartment 20.

The actuator housing 402 is also supported by various brackets (not shown) connected to the hull 12 below the actuator housing 402. The actuator housing 402 is disposed leftwardly of the intake ramp 88 as the actuator arm 404 is connected to the left side of the gate 110. It is contemplated that the actuator arm 404 could be connected to the right side of the gate 110 and the actuator housing disposed rightwardly of the intake ramp 88. It is also contemplated that the actuator housing 402 could be partially or fully disposed outside the engine compartment 20.

The actuator housing 402 is made of several parts that can be detached from each other to disassemble the actuator housing 402. With reference to FIGS. 11A to 12B, the actuator housing 402 includes a top cover 420, a middle portion 422 and a bottom cover 424. The actuator arm 404, the electric motor 406, a position sensor 426 and an inner member 410 are connected to the middle portion 422. The top cover 420 is fastened to the middle portion 422 to form a chamber with the middle portion 422 enclosing a portion of the actuator arm 404, the electric motor 406 and a portion of the position sensor 426. Gaskets 438 placed along the periphery of the top cover 420 and the middle portion 422 form a sealed connection therebetween.

The electric motor 406 is mounted on the left side of the middle portion 422 to a front wall 402*a* thereof. The electric motor 406 is operatively connected to the actuator arm 404 via several gears 428 (FIG. 12B). The position sensor 426 is fixed to the actuator arm 404 and extends through the bottom wall 402*c* of the middle portion 422 as can be seen in FIG. 13B. The bottom cover 424 enclosing the bottom wall 402*c* supports various electrical connections and electronics for controlling the actuator operations. The actuator arm 404 extends rearward from the front wall 402*a* of the actuator housing 402, through an opening 430 in the rear wall 402*b* of the actuator housing 402.

Figure 12A:
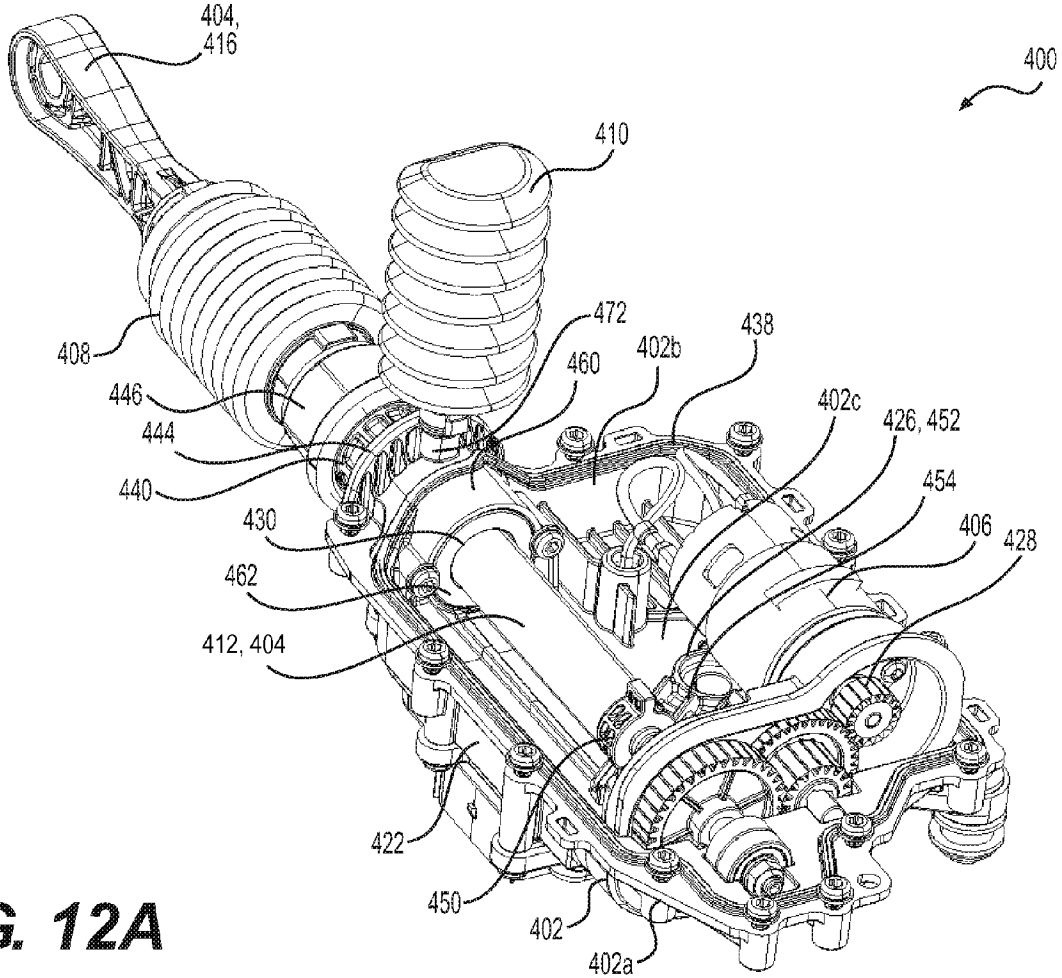
FIG. 12A is a perspective view, taken from a top, front and right side of the gate actuator assembly of FIG. 10A with a top cover and a bottom removed to show a motor and a position sensor.
Figure 12B:
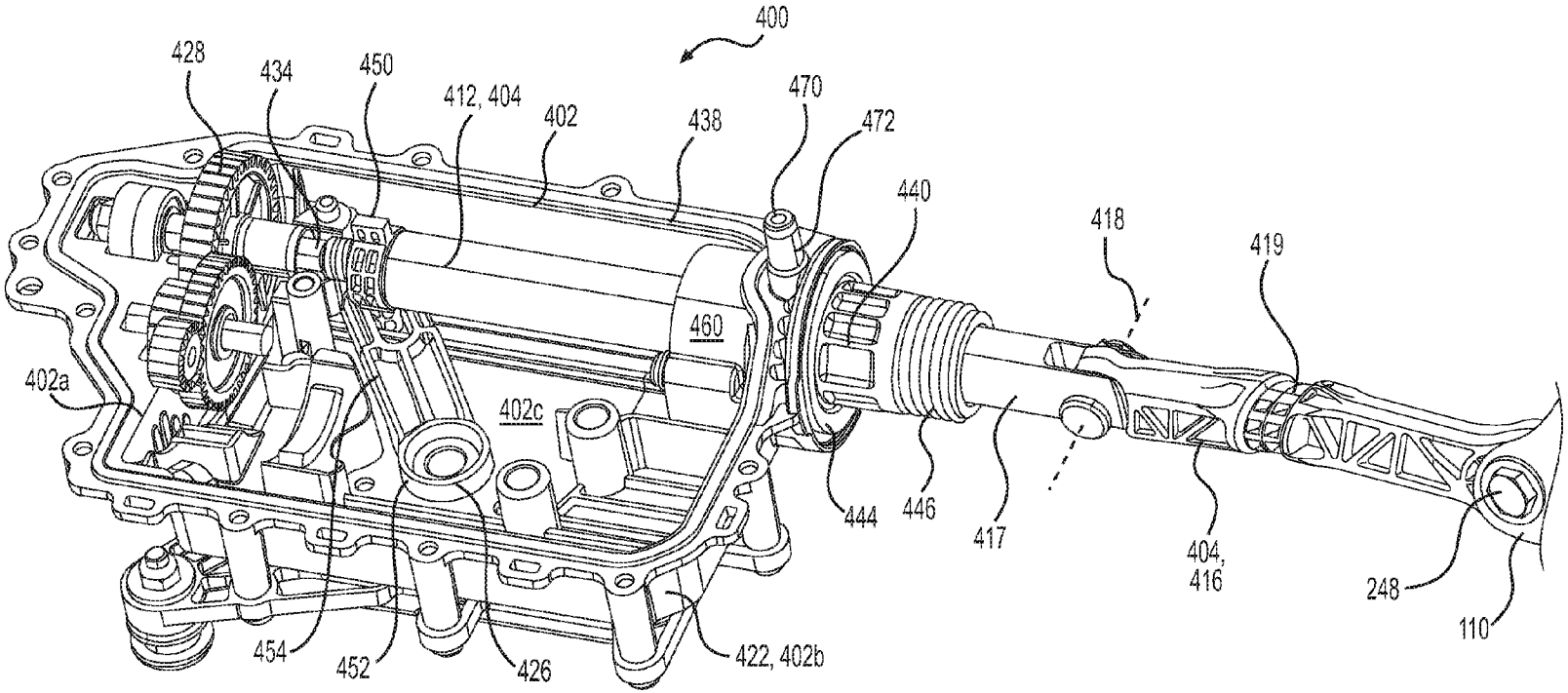
FIG. 12B is a perspective view, taken from a top, rear and left side of the gate actuator assembly of FIG. 12A with an outer bellows, an inner bellows, and the motor removed for clarity.
Figure 13:
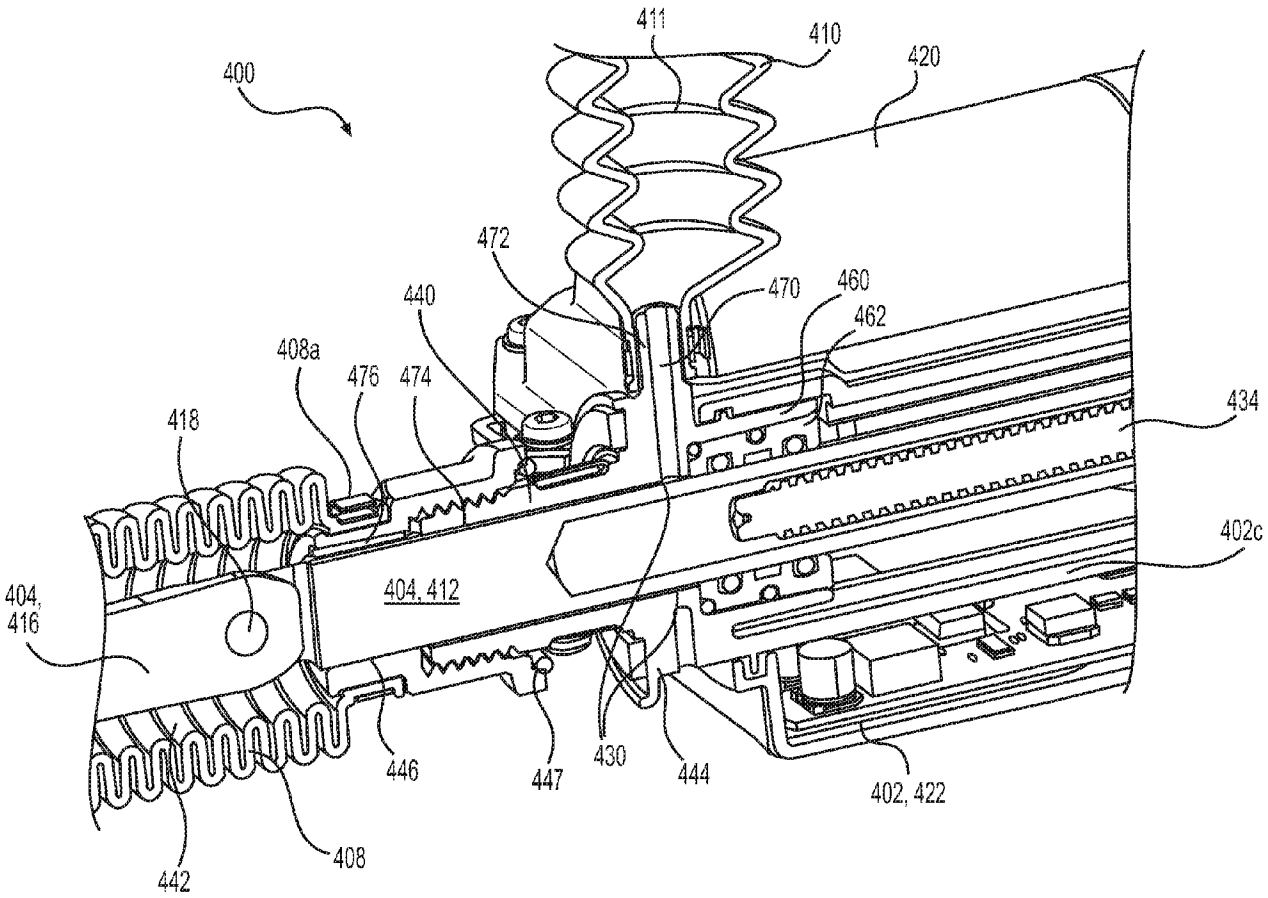
FIG. 13 is a close up longitudinal cross-section of the gate actuator assembly connected to the hull of the watercraft of FIG. 10A, as viewed from a front, left side, with the gate in a stowed position and the actuator in a retracted position.

With reference to FIGS. 12A to 13, a tubular flange 460 extends forward from the rear actuator housing wall 402*b* towards the front actuator housing wall 402*a*. The tubular flange 460 extends concentrically around the opening 430 in the rear wall 402*b* of the actuator housing 402. An annular sealing member 462 is disposed in the tubular flange 460. The sealing member 462 receives the shaft 412 therethrough. The annular sealing member 462 forms a sliding seal against the outer surface of the shaft 412. The inner diameter of the annular sealing member 462 is slightly larger than the diameter of the shaft 412 and slightly smaller than the diameter of the opening 430. Two inner grooves are formed in the inner cylindrical surface of the annular sealing member 462 facing toward the shaft 412. O-rings placed in the inner grooves form a sliding seal against the outer surface of the shaft 412. The annular sealing member 460 also includes two outer grooves formed in the outer cylindrical surface facing the tubular flange 460. O-rings placed in the outer grooves form a seal against the inner cylindrical surface of the tubular flange 460. The sealing member 462 along with the gaskets 438 thus seal the space enclosed between the top cover 420 and the middle portion 422 of the actuator housing 402.

A passage 470 is formed in the rear wall 402*b* of the actuator housing 402. The passage 470 is disposed just rearward of the annular sealing member 462 and forward of the tunnel wall 95. The passage 470 extends upward from the opening 430 to a nipple 472. The nipple 472 extends upward from the upward-facing edge of the middle portion 422 rearward of the gasket 438. The top cover 420 is disposed on the middle portion 422 forward of the nipple 472. In some implementations, such as that illustrated in FIGS. 9A and 9B, the passage 470 is open to the engine compartment 20. In some implementations, such as that illustrated in FIGS. 10A and 10B, the passage 470 is sealed from the engine compartment 20 by an inner member 410 placed around the opening of the nipple 472. The inner member 410 forms an inner chamber 411 around the nipple 472. The inner member 410 is in the form of a bellows in the illustrated implementation. The lower end of the bellows 410 is fastened around the nipple 472. The upper end of the bellows 410 is closed so as to seal the passage 470 from the engine compartment 20. The inner chamber 411 formed by the flexible bellows 410 is a variable volume chamber. It is however contemplated that the inner chamber 411 could not have a variable volume, for example, if the inner member 410 is of a rigid construction. Flexible inner members 410, other than bellows, are also contemplated. For example, the inner member 410 could be in the form of a sac, or a generally rigid container having a portion of a wall being flexible.

A sleeve member 440 extends rearward from the rear wall 402*b* of the actuator housing 402 around the opening 430. The sleeve member 440 extends out of the engine compartment 20 into the tunnel 94 through an opening 432 of the front tunnel wall 95 and an opening 433 of the pump mounting plate 97. An inner flange 444 extends radially outwardly from the front end of the sleeve member 440 and connects the sleeve member 440 to the rear actuator housing wall 402*b*. The rear surface of the inner flange 444 abuts the front tunnel wall 95 from inside the engine compartment 20. The rear end of the sleeve member 440 is disposed in the tunnel 94 and fastened to an outer flange 446 so as to retain the tunnel wall 95 and the pump mounting plate 97 between the inner and outer flanges 444, 446. In the illustrated implementation of the actuator housing 102, the cylindrical outer surface of the sleeve member 440 is threaded in the rear portion and the outer flange 446 is in the form of a threaded nut inserted over the threaded sleeve member 440. The nut 446 is tightened such that the front surface of the threaded nut 446 abuts the pump mounting plate 97. It is contemplated that an adhesive can be applied between the threaded hut 446 and the correspondingly threaded portion of the sleeve member 440 so as to prevent them from separating. A gasket 447 is placed between the pump mounting plate 97 and the nut 446. In the illustrated implementation, the sleeve member 440 and the inner flange 444 are integrally formed with the rear actuator wall 402*b* but it is contemplated that the sleeve member 440 and the inner flange 444 could not be integrally formed with the rear actuator wall 402*b*. It is also contemplated that the actuator housing could be connected to the tunnel wall 95 at a location where the pump mounting plate 97 is not present. In this case, the front surface of the outer flange 446 would abut the tunnel wall 95.

Figure 14:
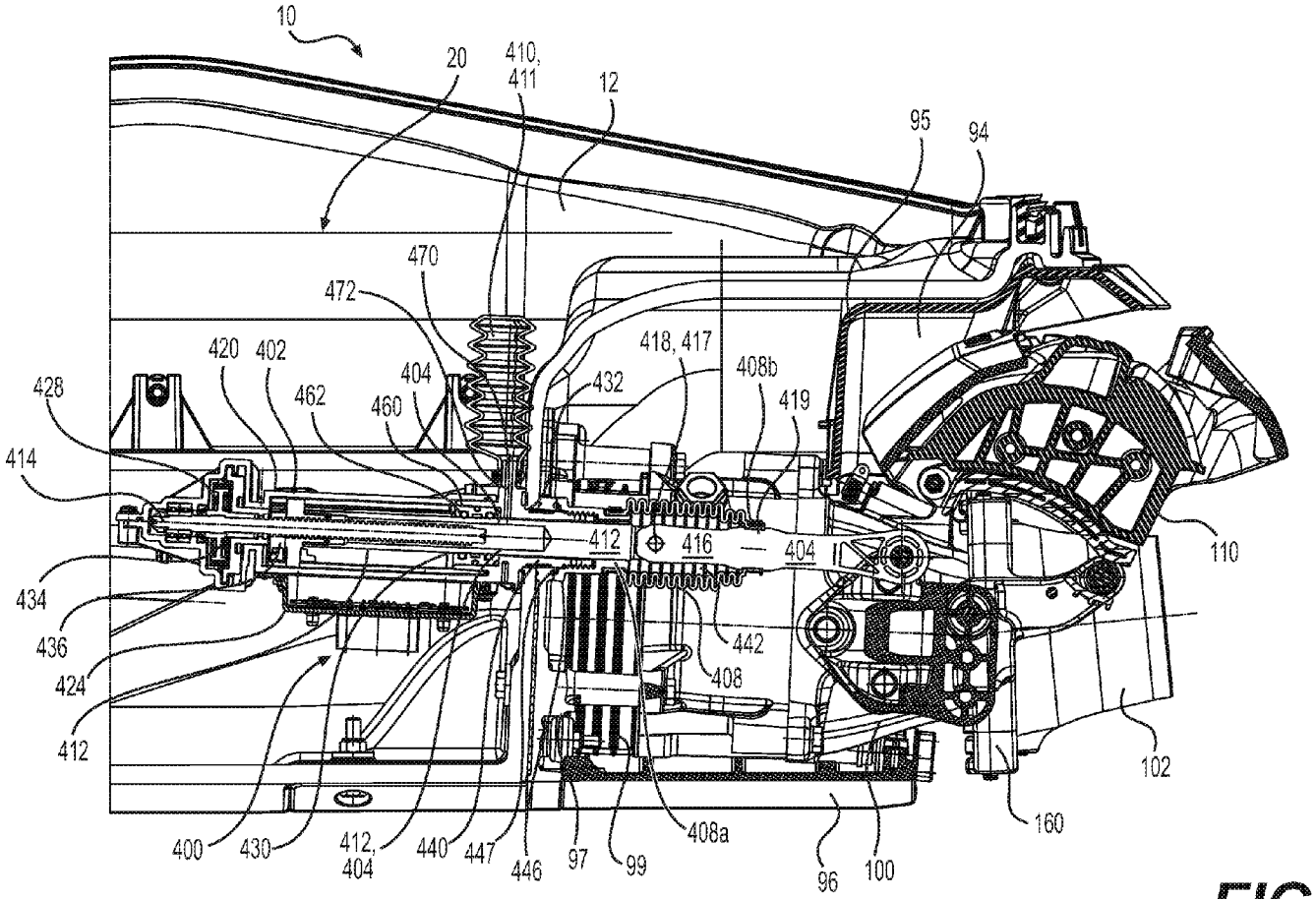
FIG. 14 is the longitudinal cross-section of FIG. 6 as viewed from the left side.

With additional reference to FIG. 14, the shaft 412 of the actuator arm 402 extends through the sleeve member 440 to connect to the reverse gate 110. A lead screw 434 is connected to a flange 436 fixed to the front end of the shaft 412. The shaft 412 disposed around the lead screw 434 defines an actuation axis 414. The flange 436 has a central opening coaxial with the actuation axis 414 and threaded in its inner surface. The lead screw 434 is fixed to the gears 428 and inserted through the central opening of the flange 436 so as to threadedly engage the flange 436. Rotation of the gears 428 rotates the lead screw 434 about the actuation axis 414 causing the flange 436 to move forward or rearward along the lead screw 434 depending on the direction of rotation of the lead screw 434. The shaft 412 fixed to the flange 436 thus moves forward or rearward along the actuation axis 414 when the lead screw 434 rotates about the actuation axis 414. Thus, a rotation of the lead screw 434 in one of a clockwise or counter-clockwise direction causes the shaft 412 to move forward along the actuation axis 414 while a rotation of the lead screw 434 in the opposite direction causes the shaft 412 to move rearward along the actuation axis 414. The rear portion of the shaft 412 thus moves in and out of the actuator housing 402 through the openings 430, 432 of the actuator housing and hull 12 when the lead screw rotates.

With reference to FIG. 12B, the linkage 416 is pivotally connected to the rear end of the shaft 412 by a clevis 417. The linkage 416 is disposed rearward of the rear wall 402*b* of actuator housing 102 and the front wall 95 of the tunnel 94. The linkage 416 is connected to the right side of the reverse gate 110. The linkage 416 is pivotable about a lateral and horizontal pivot axis 418 defined by the clevis 417. The pivot axis 418 thus intersects the actuation axis 414 and is perpendicular thereto. The pivot axis 418 is parallel to the gate axis 168 defined by the fastener 170. The pivot axis 418 is movable along the actuation axis 414 since the linkage 416 translates in the longitudinal direction along the actuation axis 414. In the up position of the gate, the pivot axis 418 is disposed forward of the gate axis 168. When the linkage 416 moves rearwardly, the reverse gate 110 pivots about the reverse gate axis 168 in the clockwise direction as viewed from the left side (FIG. 9B). The pivoting gate 110 in turn pivots the linkage 416 upwardly from the actuation axis 414. When the linkage 416 moves forward, the reverse gate 110 is pulled in a counter-clockwise direction as viewed from the left side. The linkage 416 is disposed along the actuation axis 414 when the reverse gate 110 is in a fully stowed position. The linkage 416 is also disposed along the actuation axis 414 when the reverse gate 110 is in a down fully lowered position. When the gate 110 is in a position between the up and down positions (not shown), the linkage 416 is pivoted upwardly and disposed at a non-zero angle with respect to the actuation axis 414. This configuration of the linkage 416 and the gate 110 allows the actuator arm 402 to exert a greater force on the reverse gate 110 for moving the reverse gate 110 from the up and the down positions than for moving the reverse gate 110 from an intermediate position between the up and down positions. It is contemplated that the linkage 416 could be pivoted downwardly from the actuation axis 414 when the gate 110 is in a position between the up and down positions.

Although the illustrated implementation of the actuator arm 404 includes the pivotal linkage 416 connected to the linearly translating shaft 412, it is contemplated that the linkage 416 could be omitted. In such a case, the reverse gate 110 could be provided with a fastener slot instead of a fastener aperture for the fastener 248 in order to accommodate linear translation of the shaft 412 in addition to pivotal motion of the reverse gate connected to the shaft 412, although other arrangements are contemplated. It is also contemplated that the shaft 412 could be connected to the reverse gate 110 via a plurality of rigid linkages.

The position of the actuator arm 404 can be controlled based on signals received from sensors connected to one or more of the lever 77, and buttons 80 for the personal watercraft 10, a speed sensor 106 and/or from a steering position sensor (not shown) so as to provide the VTS position and reverse gate position desired by the driver of the watercraft. It is contemplated that the position of the actuator arm 404 could be automatically controlled by an electronic control unit without any driver intervention based on conditions of the watercraft and engine 22, such as vehicle speed, throttle lever position, and engine speed so as to provide the appropriate VTS position and reverse gate position. It is also contemplated that a combination of automatic control and driver input could be used to control the position of the actuator arm 404. For example, the VTS position and some reverse gate positions could be automatically controlled, but the driver (through a lever, button, or pedal) would provide the input to the actuator 404 that a reverse operation of the watercraft is desired.

With reference to FIGS. 11A to 12B, the gate actuator assembly 400 includes the position sensor 426 for controlling operation of the actuator arm 404. In the illustrated implementation, the position sensor 426 is a magnetic hall-effect sensor assembly. A circular flange 450 is fixed around the outer cylindrical surface of the shaft 412. A hall-effect sensor 452 is fixed to the floor 402*c* of the middle portion 422. An arm 454 comprising a magnet is pivotably connected to the hall-effect sensor 452. The arm 454 engages a tab extending downwards from the flange 450 so that the arm 454 is rotated by a translation of the shaft 412. The hall-effect sensor 426 thereby senses the position of the actuator arm 404. It is contemplated that other types of position sensors such as an optical sensor, a mechanical sprig type sensor and the like could also be used to sense the position of the actuator arm 404.

A sealing member 408 forms an outer chamber 442 enclosing a portion of the actuator arm 404 extending in the tunnel 94. In the illustrated implementation, the sealing member 408 is a bellows but it is contemplated that the sealing member 408 could be other than the bellows 408. The sealing member 408 prevents entry of fluid (water and wet air) being flung around in the tunnel 94 into the outer chamber 442 in order to protect the actuator shaft 412 from moisture related damage and prolonging life of the gate actuator assembly 400.

The bellows 408 has a front end 408*a* and a rear end 408*b*. The front end 408*a* is connected to the outer surface of the housing 402, and more specifically to the nut 446. The front end 408*a* is therefore fixed with respect to the actuator housing 402 and the hull 12. It is contemplated that the front end 408*a* could be connected to a portion of the actuator housing 402 other than the nut 446, such as the sleeve member 440. The front end 408*a* could also be connected to the hull 12, the pump mounting plate 97 or part that is fixed with respect to the actuator housing 402. The rear end 408*b* of the bellows 408 is connected to the linkage 416. The rear end 408*b* is thus fixed with respect to the actuator arm 402 and movable with respect to the actuator housing 402 and the hull 12. The rear end 408*b* is connected to a shoulder 419 formed in the middle of the linkage 416 such that the front portion of the linkage 416 is also enclosed within the outer chamber 442 formed by the bellows 408. It is contemplated that the rear end 408*b* could be fixed to the linkage 416 at a different location than as shown herein. It is also contemplated that the rear end 408*b* could be fixed to the gate 110 so that bellows 408 encloses the linkage 416 as well as the shaft 412.

The outer chamber 442 formed by the flexible bellows 408 has a variable volume between the stationary (with respect to the watercraft 10) front end 408*a* and the movable rear end 408*b*. The volume of the outer chamber 442 thus varies with the motion of the actuator arm 404.

With reference to FIG. 13, a passage 474 fluidly communicates the outer chamber 442 with the passage 470 extending into the engine compartment through the nipple 472. A rear portion of the passage 474 is formed between the nut 446 and the shaft 412. The rear portion of the passage 474 is defined by a groove 476 extending into the inner cylindrical surface of the nut 446. A forward portion of the passage 474 is formed between the inner surface of the sleeve member 440 and the shaft 412 and connected to the passage 470. The sealing member 462 prevents fluid communication between the passage 474 and the space enclosed between the top cover 420 and middle portion 422 of the actuator housing 402. It is contemplated that the passage 474 could not extend through the sleeve member 440 but through another path through the hull 12 into the engine compartment 20. It is further contemplated that the passage could extend through a different opening than the openings 432, 433 of the tunnel wall 95 and the pump mounting plate 97 respectively.

When the actuator arm 404 is pushed rearward, the outer chamber 442 expands drawing in air through the passages 474, 470. When the actuator arm 404 is pulled forward, the volume of the outer chamber 442 decreases, the air within the outer chamber being pushed out through the passages 474, 470. If the passage 470 is open to the engine compartment 20, the air is drawn from and expelled into the engine compartment 20 during actuation of the gate 110. If the passage 470 is sealed from the engine compartment 20 by the bellows 410 placed around the nipple 472, air is drawn from and expelled into the inner chamber 411. The volume of the outer bellows 408 increases when the volume of the inner bellows 410 decreases and vice versa. The air pressure in the outer chamber 442 thus remains equilibriated during operation of the actuation arm 404.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull;

an engine compartment defined at least in part by the hull;

an engine disposed in the engine compartment; and a jet pump connected to the hull and operatively connected to the engine, the jet pump creating a fluid jet and thereby propelling the watercraft;

a gate being pivotable relative to the jet pump about a gate axis between an up position and a down position to redirect the fluid jet when in the down position; and a gate actuator assembly comprising:

an actuator housing fixed to the hull;

an actuator arm being movable along an actuation axis with respect to the actuator housing, the actuator arm being operatively connected to the gate for pivoting the gate about the gate axis;

a sealing member enclosing a portion of the actuator arm between the actuator housing and the gate, the sealing member extending between a first end and a second end, the first end being fixed with respect to the actuator housing, the second end being fixed with respect to the actuator arm, the sealing member forming a variable volume outer chamber between the first and second ends and around the portion of the actuator arm, the sealing member preventing entry of fluid from outside the engine compartment into the outer chamber; and a passage in fluid communication with the outer chamber and extending through the hull into the engine compartment.

2. The watercraft of claim 1, wherein the sealing member is a bellows.

3. The watercraft of claim 1, wherein the passage is in fluid communication with the engine compartment.

4. The watercraft of claim 1, further comprising an inner member forming an inner chamber disposed in the engine compartment, the passage fluidly communicating the outer chamber with the inner chamber.

5. The watercraft of claim 4, wherein the inner chamber is a variable volume chamber.

6. The watercraft of claim 1, wherein the actuator housing is mounted within the engine compartment and the actuator arm extends through an opening in the hull.

7. The watercraft of claim 6, wherein a portion of the actuator housing extends through the opening of the hull around the actuator arm.

8. The watercraft of claim 7, wherein the passage is defined at least in part between the portion of the actuator housing and the actuator arm.

9. The watercraft of claim 7, wherein the sealing member is an outer bellows, a first end of the outer bellows being fixed to the portion of the actuator housing and a second end of the outer bellows being fixed to the actuator arm.

10. The watercraft of claim 7, wherein the portion of the actuator housing comprises:

an inner flange disposed adjacent to an inner surface of the hull;

a sleeve extending from the inner flange through the opening of the hull and around the actuator arm, one of an outer and an inner surface of the sleeve being threaded; and an outer flange being threadedly fastened to the sleeve so as to retain the hull between the inner flange and the outer flange.

11. The watercraft of claim 1, wherein the actuator arm comprises:

a shaft at least partially enclosed by the actuator housing and movable with respect to the actuator housing along the actuation axis; and a linkage pivotably connected to the shaft, the linkage being connected to the gate and being pivotable about a pivot axis disposed generally perpendicular to the actuation axis and parallel to the gate axis when the gate pivots about the gate axis.

12. The watercraft of claim 11, wherein the linkage is disposed along the actuation axis when the gate is in at least one of the up position and the down position.

13. The watercraft of claim 12, wherein:

the linkage is disposed along the actuation axis when the gate is in the up position;

the linkage is disposed along the actuation axis when the gate is in the down position; and the linkage is disposed at a non-zero angle with respect to actuation axis when the gate is in a position between the up position and the down position.

14. A gate actuator assembly for pivoting a gate of a watercraft having a jet propulsion system and a hull, the hull defining at least in part an engine compartment, the gate actuator assembly comprising:

an actuator housing adapted to be connected to the hull;

an actuator arm being movable along an actuation axis with respect to the actuator housing and being adapted to be operatively connected to the gate for pivoting the gate; and a sealing member enclosing a portion of the actuator arm outside the actuator housing, the sealing member extending between a first end and a second end, the first end being fixed with respect to the actuator housing, the second end being fixed with respect to the actuator arm, the sealing member forming a variable volume outer chamber between the first and second ends and around the portion of the actuator arm, the sealing member being adapted to prevent entry into the outer chamber of fluid outside from outside the outer chamber, the sealing member being adapted for fluid communication with a passage extending through the hull into the engine compartment.

15. The gate actuator assembly of claim 14, wherein the actuator housing is adapted to be mounted inside the engine compartment, the actuator arm being adapted to extend through an opening of the hull, a portion of the actuator housing being adapted to extend through the opening of the hull around the actuator arm.

16. The gate actuator assembly of claim 14, wherein the sealing member is a bellows.

17. The gate actuator assembly of claim 14, further comprising an inner member defining an inner chamber, the inner member being adapted to be disposed inside the engine compartment, the passage fluidly communicating the outer chamber with the inner chamber.

18. The gate actuator assembly of claim 17, wherein the inner chamber is a variable volume chamber.

19. The gate actuator assembly of claim 18, wherein the inner member is a bellows.

20. The gate actuator assembly of claim 14, wherein the actuator arm comprises:

a shaft at least partially enclosed by the actuator housing and movable with respect to the actuator housing along the actuation axis; and a linkage pivotably connected to the shaft, the linkage being adapted to be connected to the gate and being pivotable about a pivot axis disposed generally perpendicular to the actuation axis for pivoting the gate about a gate axis.

* * * * *